US007437113B2

(12) United States Patent
Suzuki et al.

(10) Patent No.: US 7,437,113 B2
(45) Date of Patent: Oct. 14, 2008

(54) IMAGE FORMING APPARATUS WITH MAGNETIC FLUX SHIELDS AND RECOVERY OPERATION

(75) Inventors: Hitoshi Suzuki, Matsudo (JP); Naoyuki Yamamoto, Toride (JP); Takahiro Nakase, Toride (JP); Toshiharu Kondo, Moriya (JP); Yasuhiro Yoshimura, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 11/254,834

(22) Filed: Oct. 21, 2005

(65) Prior Publication Data

US 2006/0088329 A1 Apr. 27, 2006

(30) Foreign Application Priority Data

Oct. 22, 2004 (JP) ..... 2004-308738

(51) Int. Cl.
*G03G 15/20* (2006.01)

(52) U.S. Cl. ..... 399/328; 399/334; 219/216; 219/619

(58) Field of Classification Search ..... 399/69, 399/328, 330, 334; 219/216, 388, 469, 619
See application file for complete search history.

(56) References Cited

U.S. PATENT DOCUMENTS

| | | | | |
|---|---|---|---|---|
| 5,464,964 | A | 11/1995 | Okuda et al. | 219/497 |
| 5,534,987 | A | 7/1996 | Ohtsuka et al. | 355/285 |
| 5,747,774 | A | 5/1998 | Suzuki et al. | 219/216 |
| 5,994,671 | A | 11/1999 | Suzuki et al. | 219/216 |
| 6,219,522 | B1 | 4/2001 | Ishizuka et al. | 399/333 |
| 6,373,036 | B2 | 4/2002 | Suzuki | 219/619 |
| 6,453,144 | B1 * | 9/2002 | Sato | 399/328 |
| 6,492,630 | B2 * | 12/2002 | Nagahira | 219/619 |
| 6,687,481 | B2 * | 2/2004 | Watanabe et al. | 399/328 |
| 6,713,734 | B2 | 3/2004 | Suzuki | 219/619 |
| 6,782,216 | B2 | 8/2004 | Suzuki | 399/69 |

(Continued)

FOREIGN PATENT DOCUMENTS

| | | |
|---|---|---|
| JP | 10-74009 | 3/1998 |

*Primary Examiner*—Robert Beatty
(74) *Attorney, Agent, or Firm*—Fitzpatrick, Cella, Harper & Scinto

(57) ABSTRACT

An image heating apparatus has a coil for generating magnetic flux, a rotatable heat generation member which generates heat by magnetic flux, a temperature detecting member for detecting a temperature of the heat generation member, an energization controller portion for controlling energization to the coil on the basis of an output of the temperature detecting member, a first magnetic flux shielding portion for blocking, in a first magnetic flux adjustment position, the magnetic flux directed toward a central portion of heat generation member, while permitting the magnetic flux directed to an end portion, and a second magnetic flux shielding portion for blocking, in a second magnetic flux adjustment position, the magnetic flux directed toward an end portion of the heat generation member, a moving unit for moving the first magnetic flux shielding portion and the second magnetic flux shielding portion, and a recovery operation controller portion for retracting the second magnetic flux shielding portion from the second magnetic flux adjustment position and moving the first magnetic flux shielding portion to the first magnetic flux adjustment position after completion of an image formation job on recording materials having widths smaller than a maximum width of a recording material which can be fed are continuously fed, and executing energization control of the energization controller portion.

18 Claims, 15 Drawing Sheets

U.S. PATENT DOCUMENTS

| | | | | |
|---|---|---|---|---|
| 6,969,833 | B2 | 11/2005 | Suzuki | 219/619 |
| 6,970,664 | B2 | 11/2005 | Yamamoto | 399/69 |
| 7,034,261 | B2 | 4/2006 | Suzuki | 219/619 |
| 7,038,178 | B2 | 5/2006 | Suzuki | 219/619 |
| 7,098,430 | B2 | 8/2006 | Kondo et al. | 219/619 |
| 7,099,616 | B2 * | 8/2006 | Kato et al. | 399/328 |
| 7,109,449 | B2 * | 9/2006 | Kawase | 219/619 |
| 7,122,769 | B2 | 10/2006 | Nami et al. | 219/619 |
| 7,132,631 | B2 | 11/2006 | Nami et al. | 219/619 |
| 7,238,924 | B2 * | 7/2007 | Kondo et al. | 219/619 |
| 7,268,326 | B2 * | 9/2007 | Yamamoto et al. | 219/619 |
| 7,268,327 | B2 * | 9/2007 | Yamamoto et al. | 219/619 |
| 2005/0173415 | A1 | 8/2005 | Yamamoto et al. | 219/619 |
| 2005/0252912 | A1 | 11/2005 | Yamamoto et al. | 219/619 |
| 2006/0081614 | A1 * | 4/2006 | Nami et al. | 219/619 |
| 2006/0086719 | A1 | 4/2006 | Suzuki et al. | 219/619 |
| 2006/0086720 | A1 | 4/2006 | Nakase et al. | 219/619 |
| 2006/0086724 | A1 | 4/2006 | Yamamoto et al. | 219/619 |
| 2006/0086726 | A1 | 4/2006 | Yamamoto et al. | 219/619 |
| 2006/0086730 | A1 | 4/2006 | Kondo et al. | 219/645 |
| 2006/0088327 | A1 | 4/2006 | Nakase et al. | 399/69 |
| 2006/0088328 | A1 | 4/2006 | Yoshimura et al. | 399/69 |
| 2006/0088329 | A1 | 4/2006 | Suzuki et al. | 399/69 |

* cited by examiner

IMAGE FORMING APPARATUS WITH MAGNETIC FLUX SHIELDS AND RECOVERY OPERATION

FIELD OF THE INVENTION AND RELATED ART

The present invention relates to an image heating apparatus employing one of the heating methods based on electromagnetic induction, which is desirable as a thermal image fixing apparatus employed by such an image forming apparatus as a copying machine, a printer, etc., which forms an image with the use of one of the electrophotographic methods, to thermally fix an unfixed image formed directly on recording medium, or an unfixed image having been transferred onto recording medium.

A heating apparatus employing a thermal roller, the heat source of which is an ordinary halogen lamp, has long been used as the fixing apparatus to be mounted in a laser beam printer, a copying machine, etc. In recent years, however, because of the energy conservation movement in the field of office automation devices, a few fixing apparatuses which employ the heating method based on electromagnetic induction have been put to practical use, in place of the widely used fixing apparatuses which employ a thermal roller, the heat source of which is a halogen lamp, for the purpose of conserving energy, as well as reducing a fixing apparatus in the length of time required for startup.

Japanese Laid-open Patent Application 10-74009 discloses one of such fixing apparatuses employing the heating method based on electromagnetic induction. This fixing apparatus comprises a means for generating a magnetic flux, and a heat generating member in which heat is generated by the magnetic flux from the magnetic flux generating means. It thermally fixes the unfixed on recording medium with the heat from the heat generating member.

From the standpoint of energy conservation and quicker startup, the heat generating member is formed of iron, nickel, SOS, or the like, so that its wall can be rendered as thin as possible. This approach is for keeping the heat generating member as strong as possible while reducing it in thermal capacity. However, this exacerbates the problem that when a recording medium, the size of which is smaller than that of the largest recording medium conveyable through a fixing apparatus, is conveyed through the fixing apparatus, the portions of the fixation roller, which correspond to the areas outside the path of the recording medium, excessively increase in temperature.

Thus, the fixing apparatus, disclosed in Japanese Laid-open Patent Application 10-74009, which employs the heating method of the electromagnetic induction type, is provided with a magnetic flux adjusting member for partially blocking the magnetic flux which is emitted from the magnetic flux generating means toward the heating member, and a means for moving the magnetic flux adjusting member according to the size and location of the path of a recording medium relative to the heat generating member. In operation, the magnetic flux adjusting member is changed in position by a magnetic flux adjusting member moving means, according to the width and location of the recording medium path relative to the heat generating member, in order to prevent the portions of the heating member, which are outside the path of the recording medium, from excessively increasing in temperature.

However, the above described method for preventing the excessive increase in temperature suffers from the following problem: While multiple recording mediums of a given size (smaller than maximum size) are continuously fed, the portions of the heat generating member shielded from the magnetic flux by the magnetic flux adjusting member, that is, the portions of the heat generating member outside the recording medium path in terms of the lengthwise direction of the heat generating member, substantially reduce in temperature. Thus, if a recording medium of the large size is fed immediately after the continuous feeding of the multiple recording mediums of a small size, the portions of the unfixed image on the portions of the recording medium of the large size, which correspond in position to the abovementioned portions of the heat generating member outside the path of a recording medium of the small size will be inadequately fixed, or the like problem will occur.

As for the means for dealing with this problem, that is, as for the method for minimizing the heat generating member in the nonuniformity in temperature in terms of the direction perpendicular to the recording medium conveyance direction, it is possible to idle the heat generating member during the period between a job in which multiple recording mediums of a small size are continuously conveyed, and the following job in which a single or multiple recording mediums, which are greater in width than the recording mediums used in the preceding job are used. However this idling of the heat generating member adds to the length of the downtime, reducing thereby the image forming apparatus in usability.

SUMMARY OF THE INVENTION

Thus, the primary object of the present invention is to quickly reduce the heat generating member in the difference in temperature between the portions shielded from the magnetic flux by the magnetic flux blocking portions of the magnetic flux adjusting member, that is, the portions outside the recording medium path, and the portion inside the recording medium path.

According to an aspect of the present invention, there is provided an image heating apparatus comprising a coil for generating a magnetic flux by current flowing therethrough; an image heating member for heating an image on a recording material which is fed therethrough, said image heating member producing heat by eddy current generated by the magnetic flux; electric power supply control means for controlling electric power supply to said coil so as to provide said image heating member with a predetermined temperature; magnetic flux adjusting means for adjusting a magnetic flux in a direction perpendicular to a feeding direction of the recording material, said magnetic flux adjusting means having a first magnetic flux adjusting portion for reducing, by relative movement thereof relative to said coil, a magnetic flux directing toward an end of said image heating member adjacent to a sheet feedable range with respect to the direction, and a second magnetic flux adjusting portion for reducing, by relative movement thereof relative to said coil, a magnetic flux directing toward said image heating member in a sheet feeding range in which at least a minimum size recording material is fed, with respect to the direction; and setting means for setting said relative positions of said first magnetic flux adjusting portion and said second magnetic flux adjusting portion to be taken after continuous feeding of the recording materials having a size smaller than a maximum feedable size of said apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

(1) Example of Image Forming Apparatus

Figure 1:
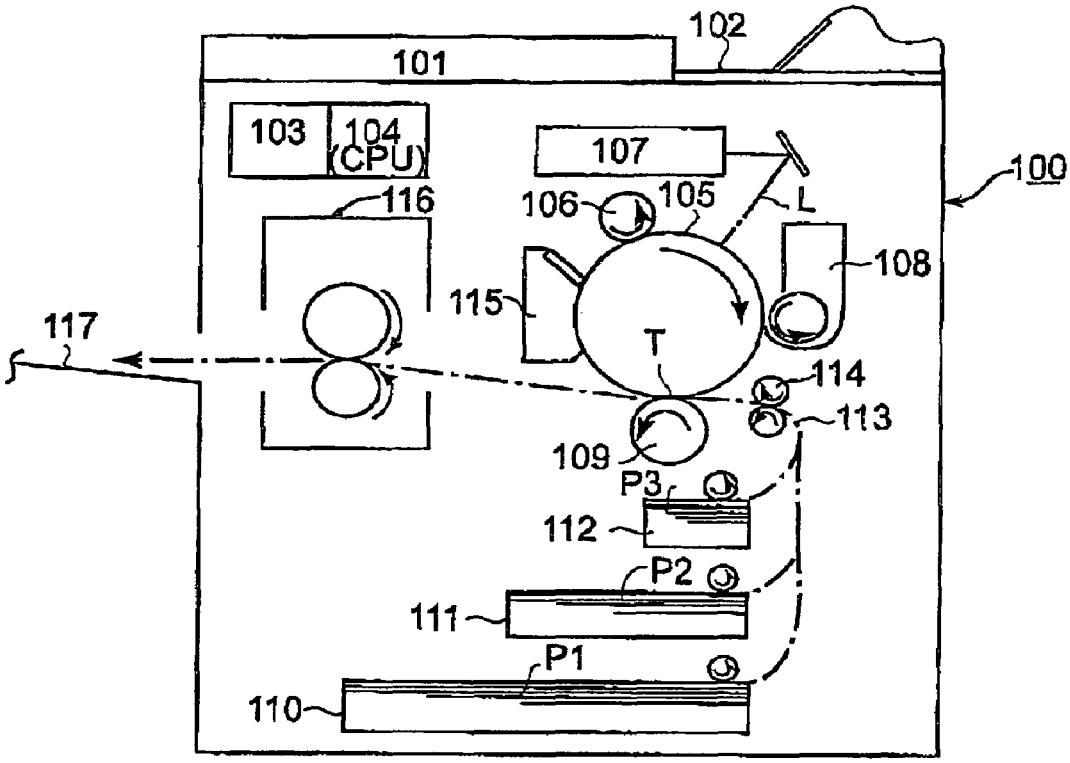
FIG. 1 is a schematic sectional view of a typical image forming apparatus, showing the general structure thereof.

FIG. 1 is a schematic drawing of a typical image forming apparatus employing a heating apparatus, as a thermal image fixing apparatus, in accordance with the present invention, which uses the heating method based on electromagnetic induction, showing the general structure thereof. This example of image forming apparatus 100 is a digital image forming apparatus (copying apparatus, printer, facsimileing machine, multifunctional image forming apparatus capable of performing the functions of two or more of preceding examples of image forming apparatuses, etc.) of the transfer types which uses the electrophotographic process and the exposing method based on laser based scanning.

Designated by referential symbols 101 and 102 are an original reading apparatus (image scanner) and an area designating apparatus (digitizer), respectively, which constitute the top portions of the main assembly of the image forming apparatus 100. The image scanner 101 comprises: an original placement platen; an optical system for illuminating and scanning an original, which has an internal light source, etc.; a light sensor such as a CCD line sensor; etc. In operation, the surface of an original placed on the original placement platen is scanned to read the light reflected by the surface of the original, by the light sensor, and the thus obtained data of the original are converted into sequential digital electrical signals which correspond to picture elements. The area designating apparatus 102 sets the area of the original, which is to be read, etc., and outputs signals. Designated by a referential symbol 103 is a print controller, which outputs print signals based on the image formation data from a personal computer (unshown) or the like. Designated by a referential symbol 104 is a control portion (CPU) which processes the signals from the image scanner 101, area designating apparatus 102, print controller 103, etc., and sends commands to various portions of the image outputting mechanism The control portion 104 also controls various image formation sequences.

Described next will be the image outputting mechanism (image forming mechanism). A referential symbol 105 designates an electrophotographic photosensitive member, as an image bearing member, in the form of a rotatable drum (which hereinafter will be referred to simply as photosensitive drum), which is rotationally driven in the clockwise direction indicated by an arrow mark at a preset peripheral velocity As the photosensitive drum 105 is rotated, it is uniformly charged to preset polarity and potential level by a charging apparatus 106. The uniformly charged peripheral surface of the photosensitive drum 105 is exposed to a beam of image formation light L projected by an image writing apparatus 107. As the uniformly charged peripheral surface of the photosensitive drum 105 is exposed, 20 numerous exposed points of the uniformly charged peripheral surface of the photosensitive drum 105 reduce in potential level. As a result, an electrostatic latent image, which matches the exposure pattern, is effected on the peripheral surface of the photosensitive drum 105. The image writing apparatus 107 of this example of image forming apparatus is a laser scanner, which outputs a beam of laser light L while modulating it with image formation signals which the control portion 104 (CPU), as a controlling means, outputs by processing the image formation data. The uniformly charged peripheral surface of the photosensitive drum 105 is scanned (exposed) by this beam of light L As a result, an electrostatic latent image reflecting the image formation data obtained from the original is formed.

The electrostatic latent image is developed by a developing apparatus 108 into a visible image formed of toner (which hereinafter will be referred to as toner image). The toner image is electrostatically transferred from the peripheral surface of the photosensitive drum 105 onto a sheet of recording medium P such as paper, OHP film, etc., as an object to be heated, in the transferring portion, that is, the location of a transfer charging apparatus 109, which is where the photosensitive drum 105 and transfer charging apparatus 109 oppose each other, and to which the recording medium P is conveyed, with a preset control timing, from the sheet feeding mechanism.

The sheet feeding mechanism of the image forming apparatus in this embodiment is provided with: a first sheet feeding portion 110 employing a cassette in which recording mediums of the largest size P1 usable with the apparatus are stored; a second sheet feeding portion ill employing a cassette in which recording mediums of the medium size P2 usable with the apparatus are stored; a third sheet feeding portion 112 employing a cassette in which recording mediums of the smallest size usable with the apparatus are stored; and a recording medium conveying portion 113 which conveys, with the preset timing, to the transferring portion T, each of the recording mediums P fed, while being separated one by one, into the main assembly of the apparatus from the recording medium feeding portion selected from among the recording medium feeding portions 110, 111, and 112. The recording medium conveying portion 113 has a pair of recording medium conveyance rollers 114 (pair of registration rollers) as a recording medium conveying means, which adjusts the recording medium interval (distance between trailing edge of preceding recording medium and leading edge of trailing one) as it conveys each recording medium P to the transferring portion T, so that a preset rate of throughput is maintained.

After a toner image is transferred from the peripheral surface of the photosensitive drum 105 onto the recording medium P in the transferring portion T, the recording medium P is separated from the peripheral surface of the photosensitive drum 105, and is conveyed to a fixing apparatus 116, in which the unfixed toner image on the recording medium P is fixed to the recording medium P. After the fixation of the toner image, the recording medium P is discharged into a delivery tray 117 located outside the main assembly of the image forming apparatus.

Meanwhile, the peripheral surface of the photosensitive drum 105 is cleaned, that is, cleared of such adherent contaminants as the toner remaining on the peripheral surface of the photosensitive drum 105, by a cleaning apparatus 115, and then, is used for the next cycle of image formation; the peripheral surface of the photosensitive drum 105 is repeatedly used for image formation.

(2) Fixing Apparatus 116

1) General Structure of Fixing Apparatus

Figure 2:
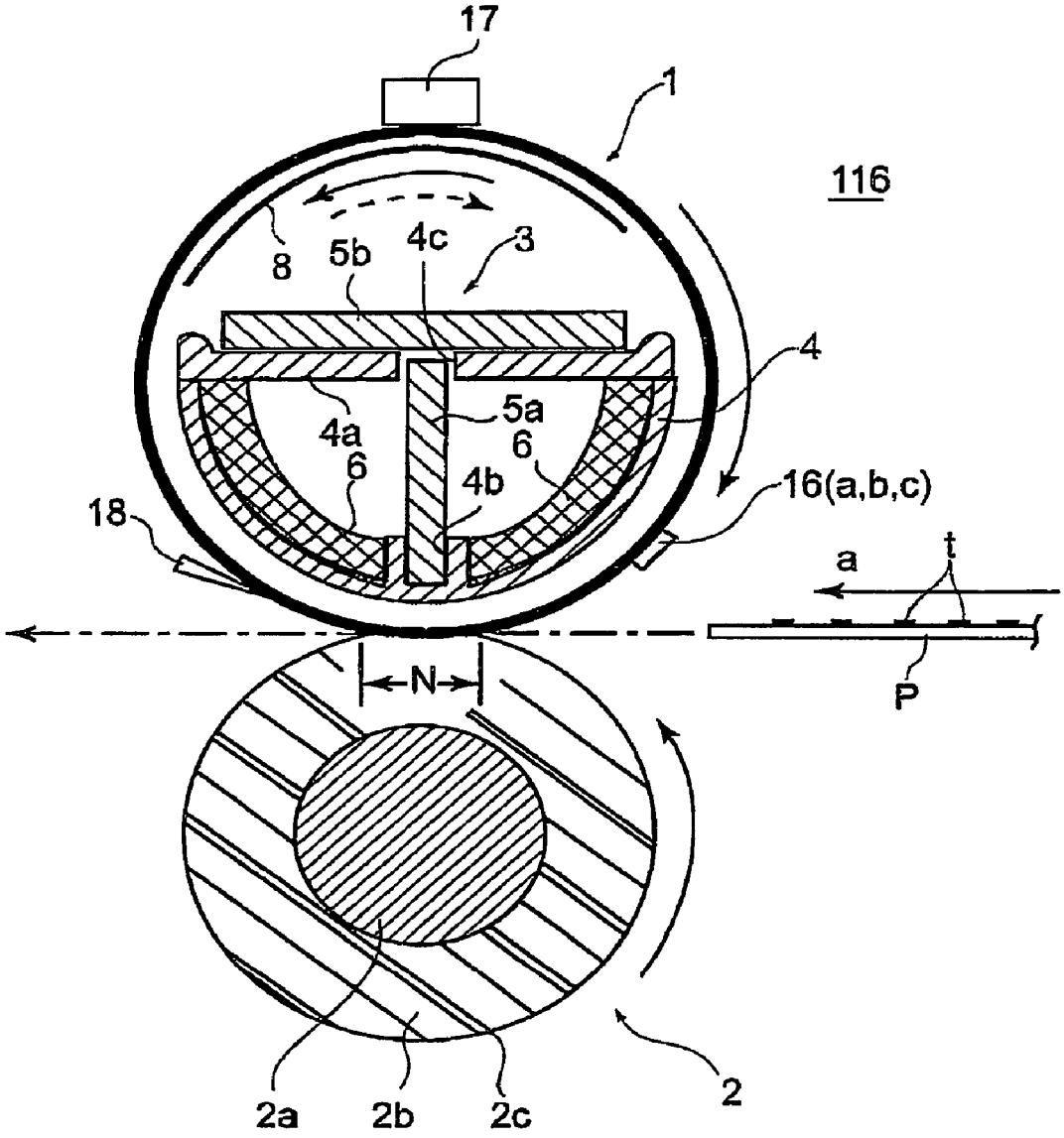
FIG. 2 is an enlarged schematic cross-sectional view of the essential portions of the fixing apparatus.
Figure 3:
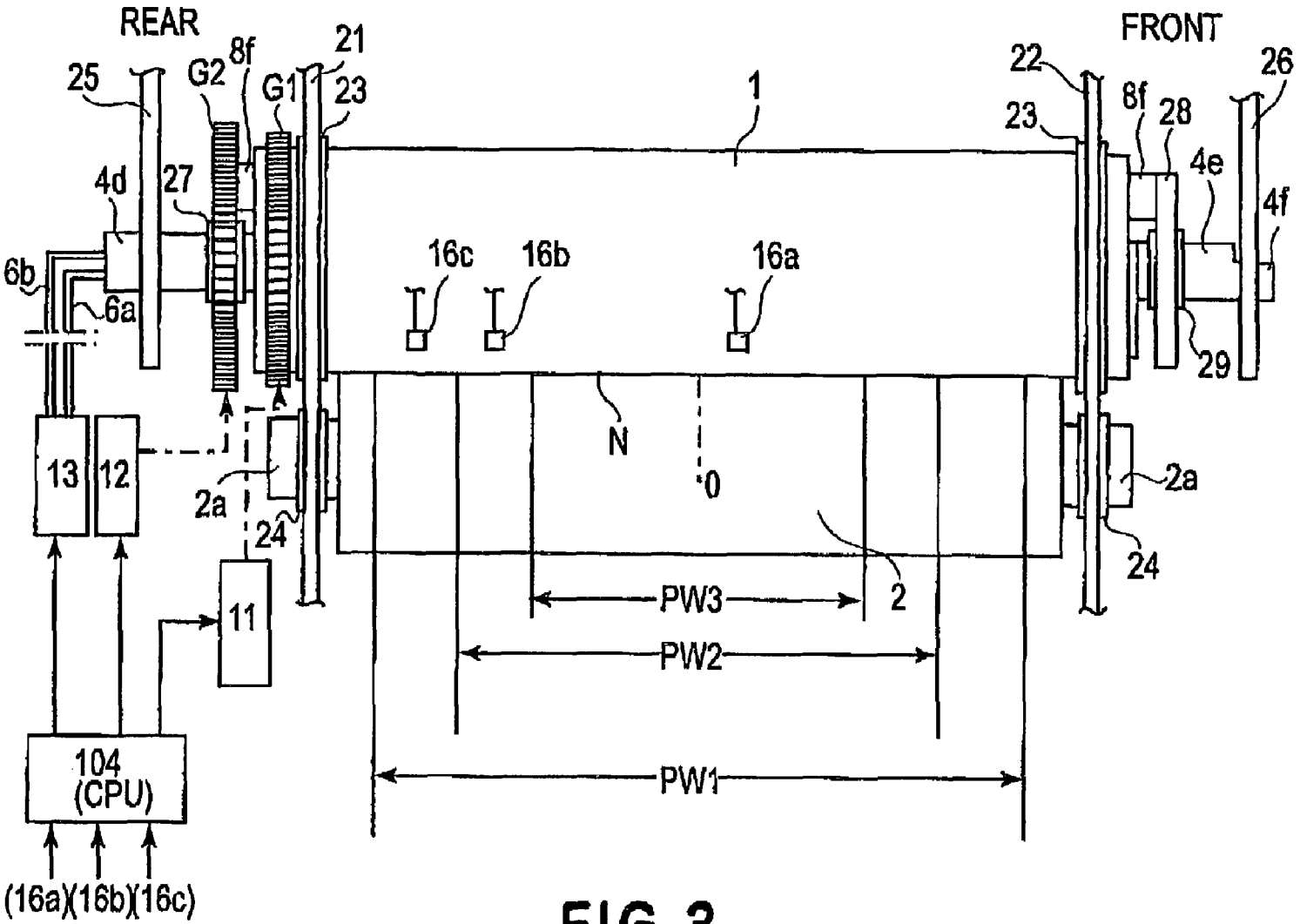
FIG. 3 is a schematic front view of the essential portion of the fixing apparatus.
Figure 4:
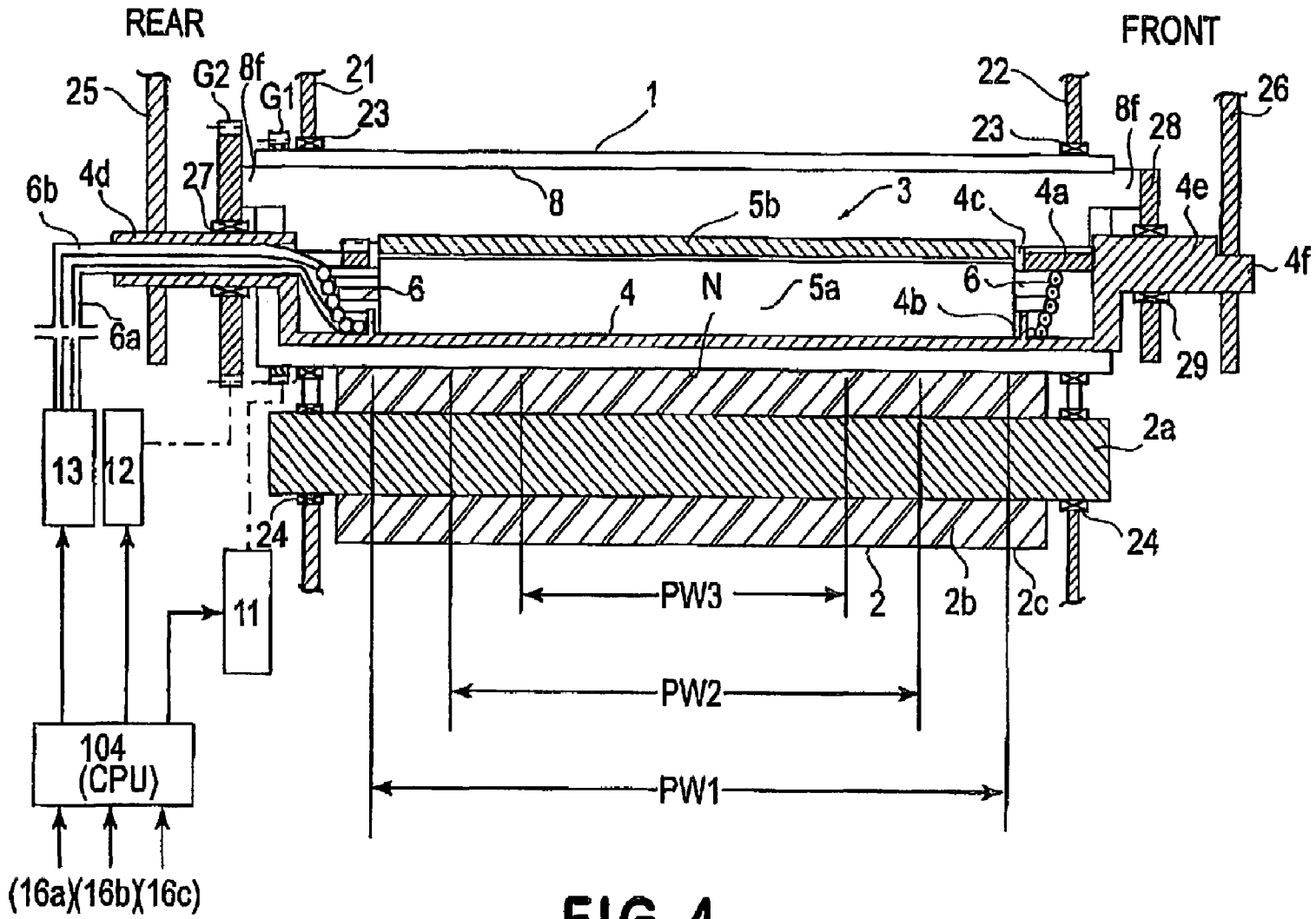
FIG. 4 is a schematic vertical sectional view of the essential portions of the fixing apparatus, at a vertical plane coinciding with the axial line of the fixation roller of the fixing apparatus.

FIG. 2 is an enlarged schematic cross-sectional view of the essential portions of the fixing apparatus 116 in this embodiment, showing the general structure thereof, and FIG. 3 is a schematic front view of the essential portions of the fixing apparatus in this embodiment. FIG. 4 is a schematic vertical sectional view of the essential portions of the fixing apparatus in this embodiment, at a plane coinciding with the axial line of the fixation roller.

The fixing apparatus 116 in this embodiment is a heating apparatus employing a heat roller and a heating method based on electromagnetic induction. Designated by a referential symbol 1 is a fixation roller as the heat generating member (heating member), and designated by a referential symbol 2 is an elastic pressure roller as a pressure applying member. The fixation roller 1 and pressure roller 2 are horizontally disposed in parallel to each other, with the pressure roller 2 located under the fixation roller 1. The pressure roller 2 is kept pressed against the fixation roller 1 with the application of a preset amount of pressure, effecting a fixation nip N (heating nip).

Hereinafter, a term, width direction (=lengthwise direction of fixation roller), of the structural components and portions of the fixing apparatus 116 means the direction (FIG. 2) perpendicular to the direction a in which recording medium (object to be heated) is conveyed through the recording medium passage of the fixing apparatus.

The fixation roller 1 is provided with an electrically conductive layer formed of such a substance (magnetic metallic or nonmetallic substance) as Ni, Fe, SUS, etc., in which heat can be inductively generated. It is a hollow cylindrical roller (which hereinafter will be referred to fixation roller), which is roughly 0.02 mm-3.0 mm in wall thickness. The surface layer of the fixation roller 1 is a toner releasing layer (thermally conductive layer), which is heat resistant. The surface layer is formed by coating the peripheral surface of the electrically conductive layer with fluorinated resin or the like. Referring to FIGS. 3 and 4, the fixation roller 1 is rotatably supported, at its lengthwise ends, by the front and rear plates 21 and 22 (of fixation unit frame) of the fixing apparatus 116, with the positioning of bearings 23 and 23 between the lengthwise end portions of the fixation roller 1 and front and rear plate 21 and 22, one for one.

In the hollow of the fixation roller 1, a coil unit 3 as a magnetic flux generating means is rigidly (nonrotatively) disposed, which generates a high frequency magnetic field for inducing electrical current (eddy current) in the wall of the fixation roller 1 to generate heat (Joule heat) in the wall of the fixation roller 1.

The pressure roller 2 is made up of a metallic core 2*a*, a heat resistant rubber layer 2*b* formed around the peripheral surface of the metallic core 2*a*, and a heat resistant releasing layer 2*c* formed of fluorinated resin or the like on the peripheral surface of the heat resistant rubber layer 2*b*. The pressure roller 2 is rotatably supported by the lengthwise ends of the metallic core 2*a*, between the aforementioned front and rear plates 21 and 22, by the front and rear plates 21 and 22, with bearings 24 and 24 positioned between the lengthwise ends of the metallic core 2*a* and front and rear plates 21 and 22, one for one. Further, the pressure roller 2 is kept pressed on the bottom side of the fixation roller 1 with the application of a preset amount of pressure by an unshown pressing means so that a preset amount of contact pressure is kept by the resiliency of the heat resistant rubber layer 2*b* between the pressure roller 2 and fixation roller 1, forming thereby the fixation nip N.

Designated by a referential symbol G1 is a fixation roller driving gear fitted fast around the rear end portion of the fixation roller 1. As the rotational force is transmitted to this gear G1 from a fixation roller driving mechanism 11 inclusive of a motor, the fixation roller 1 is rotationally driven at a preset peripheral velocity in the clockwise direction of FIG. 2. As the fixation roller 1 is rotationally driven, the pressure roller 2 is rotated by the friction which occurs between the fixation roller 1 and pressure roller 2 in the fixation nip N. The fixation roller driving mechanism 11 is controlled by the signals from the control portion 104.

Figure 5:
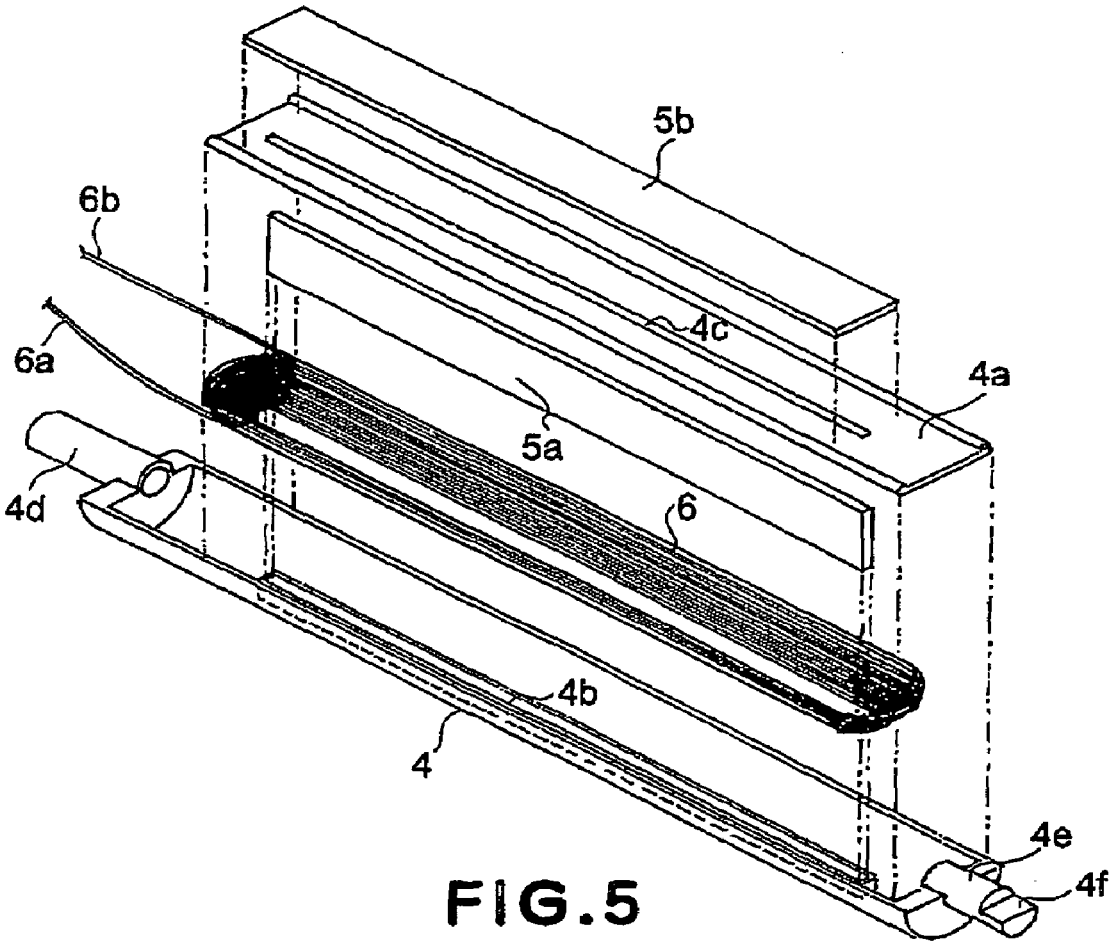
FIG. 5 is an exploded perspective view of the coil unit.

The coil unit 3, that is, the coil assembly, is made up of: a holder 4, which is roughly in the form of a trough which is roughly semicylindrical in cross section; an excitation coil 6 disposed in the hollow of the holder 4; a center core 5*a* disposed in the center portion of the hollow of the holder 4; a cover plate 4*a* placed on top of the holder 4 to cover the opening of the holder 4; a side core 5*b* disposed on the top surface of the cover plate 4*a*, etc. The external diameter of the holder 4 is slightly smaller than the internal diameter of the fixation roller 1. FIG. 5 is an exploded schematic perspective view of this coil unit 3.

The holder 4 and cover plate 4*a* are heat resistant and have a substantial amount of mechanical strength. They are formed of a nonmagnetic substance, for example, heat resistant and electrically insulative engineering plastic or the like.

The excitation coil 6 must be capable of generating an alternating magnetic flux strong enough for heating. Thus, it must be low in electrical resistance and high in inductance. As the core wire of the excitation exciting coil, Litz wire, that is, a preset number of strands of fine wires with a preset diameter, which are bound together, is used. As the fine wire, electrical wire covered with insulating substance is used. The Litz wire is wound multiple times around the center core 5*a*, making up the excitation coil 6, so that the contour of the excitation coil, which faces the internal surface of the holder 6, follows the internal surface of the holder 4. Since Litz wire is wound around the center core 5*a* which is rectangular, the resultant excitation coil 6 has a shape resembling that of a long boat, the lengthwise direction of which is parallel to that of the width direction (lengthwise direction) of the fixation roller 1. With the employment of this design, the center core 5*a* is positioned near the center of the excitation coil 6.

Designated by a referential symbol 4*b* is a groove, with which the internal surface of the holder 4 is provided to accommodate the bottom end of the center core 5*a*. In terms of the direction perpendicular to the lengthwise direction of the holder 4, the groove 4*b* is located roughly in the middle of the holder 4. The groove 4*b* extends in the direction parallel to the lengthwise direction of the holder 4. Designated by a referential symbol 4*c* is a groove, with which the cover plate 4*a* is provided to accommodate the top end of the center core 5*a*. In terms of the direction perpendicular to the lengthwise direction of the cover plate 4*a*, the groove 4*c* is located in the middle of the cover plate 4*a*. It extends in the lengthwise direction of the cover plate 4*a*. The center core 5*a* is held by the above described grooves 4*b* and 4*c* for accommodating the bottom and top ends, respectively, of the center core 5*a*, being thereby positioned roughly in the center of the holder 4.

The center core 5*a* and side core 5*b* are combined with each other, making up a magnetic core 5, which is T-shaped in cross section. The material for the core 5 is desired to be such a substance, which is high in magnetic permeability and small in internal loss, for example, ferrite, Permalloy, Sendust, amorphous silicon steel, etc. The holder 4 and cover plate 4*a* function as insulating portions for insulating the magnetic core 5 (5*a* and 5*b*) and excitation coil 6 from each other.

The rear end of the holder 4 is provided with a cylindrical shaft portion 4*d* which is hollow, whereas the front end of the holder 4 is provided with a solid shaft portion 4*e*, the outward end portion 4*f* of which is D-shaped in cross section. Also referring to FIGS. 3 and 4, the cylindrical shaft portion 4*d* is fitted in the circular hole of the secondary rear plate 25 of the fixation apparatus, being thereby supported by the secondary rear plate 25, whereas the portion 4*f* of the solid rear shaft portion 4*e*, which is D-shaped in cross section, is fitted in the hole of the secondary front plate 26, which is D-shaped in cross section, being thereby supported by the secondary front plate 26. With the employment of this structural arrangement, not only is the holder 4, in which the coil unit 3 is disposed, nonrotationally held by its rear and front ends, between the secondary rear and front plates 25 and 26, at such an angle (attitude) that causes the outward side of the holder 4, that is, the portion of the holder 4, which is comparable to the bottom side of the semicylindrical shape of the holder 4, to face downward, but also, a preset amount of gap is formed between the peripheral surface of the holder 4 and the internal surface of the fixation roller 1, as shown in FIG. 2. With the coil unit 3 disposed as described above, the fixation roller 1, hollow shaft portion 4*d* of the holder 4, and solid shaft portion 4*e* are roughly coaxial.

In other words, the coil unit 3 and fixation roller 1 are positioned so that there is a preset amount of uniform gap between the arcuate portion of the external surface of the coil unit 3 and the internal surface of the fixation roller 1.

Through the hollow cylindrical shaft portion 4*d*, a pair of lead wires 6*a* and 6*b* of the excitation coil 6 in the holder 4 are extended outward from the holder 4, and are connected to an excitation coil driving power source 13 (excitation circuit) for supplying the excitation coil 6 with high frequency electric current.

Designated by a referential symbol 8 is a magnetic flux adjusting member disposed in the hollow of the fixation roller 1. The magnetic flux adjusting portion 8 is for adjusting, in size and position, the area in which the magnetic flux from the coil unit 3 is allowed to act on the fixation roller 1, that is, for adjusting the temperature distribution of the fixation roller 1, in terms of the lengthwise direction of the fixation roller 1, by adjusting the magnetic circuit (unshown) made up of the excitation coil 6, fixation roller 1, and core 5*a* and 5*b*. This magnetic flux adjusting portion 8 will be described in detail in the next section (Section 2).

The high frequency electric power source 13 supplies the exciting coil 6 of the coil unit 3 with high frequency electric current (alternating current) in response to the signals from the control portion 104. The coil unit 3 uses the high frequency electric current supplied from the power source 13, to generate a high frequency magnetic field (alternating magnetic flux) which is parallel to the lengthwise direction of the fixation roller 1, and this alternating magnetic flux is guided to the magnetic core 5, inducing thereby eddy current in the wall of the fixation roller 1. This eddy current interacts with the specific resistivity of the fixation roller 1, generating thereby heat (Joule heat) in the wall of the fixation roller 1; in other words, the fixation roller 1 is heated by electromagnetic induction. Since the fixation roller 1 is rotationally driven, it becomes uniform in surface temperature, in terms of its circumferential direction.

Figure 6:
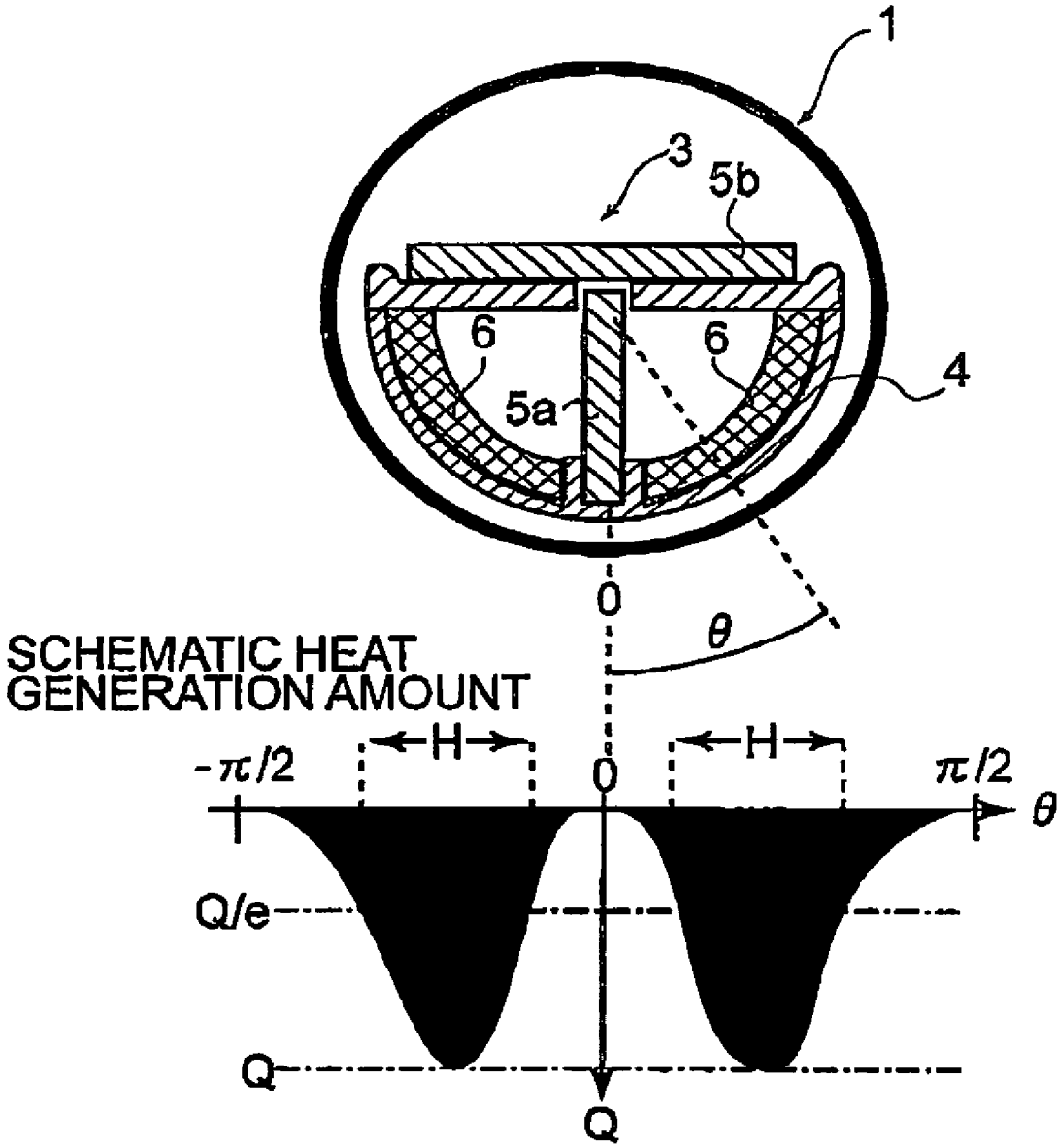
FIG. 6 is a drawing for describing the portions of the fixation roller, which correspond in position to the area, in terms of its circumferential direction, in which the major portions of the magnetic field generated by the coil unit are present, and the heat distribution of the fixation roller in terms of the circumferential direction thereof.

FIG. 6 is the combination of a schematic cross-sectional view of the fixation roller 1 in the system such as the above described one, and a diagrammatic drawing showing the heat distribution of the fixation roller 1 in the heated condition. It shows the areas in which the major portion of the magnetic flux generated by the magnetic flux generating means is present, and the corresponding heat distribution of the fixation roller 1, in terms of the circumferential direction of the fixation roller 1. As alternating electric current is flowed through the excitation coil 6 of the coil unit 3, the excitation coil 6 generates an alternating magnetic flux. The fixation roller 1 is formed of a magnetic metal or nonmetallic magnetic substance. Thus, as the alternating electric current is flowed through the excitation coil 6, eddy current is induced within the wall of the fixation roller 1, in a manner to neutralize the magnetic field. This induced eddy current generates heat (Joule heat) in the wall of the fixation roller 1, increasing thereby the fixation roller 1 in temperature. In the case of the structure of the fixing apparatus in this embodiment, the outward side of the semicylindrical holder 4, in the hollow of which the excitation coil 6 and cores 5*a* and 5*b* are disposed, is the area in which the major portion of the magnetic flux is generated, that is, the magnetic circuit (unshown) made up of the excitation coil 6, fixation coil 1, and cores 5*a* and 5*b*. Heat is electromagnetically generated in the portion of the wall of the fixation roller 1, which is in this area in which the magnetic flux is allowed to act on the fixation roller 1. Thus, the heat distribution of the fixation roller 1, in terms of the circumferential direction of the fixation roller 1, across the portion in the abovementioned magnetic flux generation area, has two areas H and H, in which most of the heat is generated, as shown in FIG. 6.

Referring to FIG. 3, the fixing apparatus in this embodiment is provided with first to third temperature detecting means 16*a*-16*c*for detecting the temperature of the fixation roller 1, which are disposed in contact, or virtually in contact, with the peripheral surface of the fixation roller 1 so that they oppose the excitation coil 6, with the presence of the wall of the fixation roller 1 between the temperature detecting means and excitation coil 6. The temperature detecting means 16*a*-16*c* are ordinary temperature detecting means, for example, thermistors, thermopiles, thermoelectric couples, etc. The information regarding the temperature of the fixation roller 1 detected by these temperature detecting means 16*a*-16*c* is inputted into the control portion 104 (controlling means). The first temperature detecting means 16*a* is used for controlling the temperature of the fixation roller 1, and is disposed so that its position roughly coincides with the center of the fixation roller 1 in terms of the lengthwise direction of the fixation roller 1. The control portion 104 controls the high frequency electric power source 13, based on the information regarding the temperature of the fixation roller 1 inputted into the control portion 104 from the first temperature detecting means 16*a*, in order to control the amount by which electric power is supplied to the excitation coil 6 from the high frequency power source 13, so that the temperature of the fixation roller 1 is kept at a preset fixation temperature (target temperature). The second and third temperature detecting means 16*b* and 16*c* will be described later. The abovementioned temperature detecting means 16*a*-16*c* may be placed in contact, or virtually in contact, with the internal surface of the fixation roller 1 so that they directly oppose the excitation coil 6.

The fixing apparatus is provided with a thermostat 17 (FIG. 2) as a safety mechanism for preventing the fixation roller 1 from abnormally increasing in temperature. The thermostat 17 is disposed in contact, or virtually in contact, with the peripheral surface of the fixation roller 1. Should the fixation roller 1 be heated to a temperature level, which exceeds a preset level, due to malfunction, the thermostat 17 immediately opens to shot the power supply to the excitation coil 6.

While the fixation roller 1 and pressure roller 2 are rotationally driven, the fixation roller 1 is electromagnetically heated to, and kept at, the preset fixation temperature, by the coil unit 3 as the magnetic flux generating means, and the recording medium P bearing the unfixed toner image t which has just been transferred onto the recording medium P is introduced into the fixation nip N from the direction indicated by an arrow mark a. Then, the recording medium P is conveyed through the fixation nip N while remaining pinched between the fixation roller 1 and pressure roller 2. As the recording medium P is conveyed through the fixation nip N, the heat from the heated fixation roller 1 and the pressure from the pressure roller 2 are applied to the recording medium P and the unfixed toner image t thereon. As a result, the unfixed toner image t is fixed to the recording medium P; a permanent copy is effected. After being conveyed through the fixation nip N, the recording medium P is separated from the fixation roller 1 by a separation claw 18, the tip of which is in contact with the peripheral surface of the fixation roller 1, and is conveyed further leftward in the drawing. The separation claw 18 is formed of a heat resistant and electrically insulative engineering plastic.

The image forming apparatus and the fixing apparatus thereof in this embodiment are structured so that when the recording medium P is conveyed through the fixing apparatus (image forming apparatus), the center of the recording medium P in terms of its width direction coincides with the center of the fixing apparatus (fixation roller 1) in terms of the width direction of the recording medium P. Referring to FIG. 3, designated by a referential symbol ○ is the centerline (hypothetical line), as the referential line, of the fixation roller 1 (recording medium) in terms of its lengthwise direction. Here, the term, recording medium width, means the dimension of a recording medium, in terms of the direction perpendicular to the recording medium conveyance direction a, when the recording medium P is completely flat. Designated by a referential symbol PW1 is the path of the largest recording medium P1 (which hereinafter will be referred to as recording medium of the large size), in terms of width, usable with the image forming apparatus. Referring to FIG. 4, the width of the path PW1 of the recording medium of the large size roughly matches the length of the main core 5*a* of the coil assembly 3. Designated by a referential symbol PW3 is the path of a recording medium P3 (which hereinafter will be referred to as recording medium of small size), which is usable with the fixing apparatus (image forming apparatus). Designated by a referential symbol PW2 is the path of a recording medium P2 (which hereinafter will be referred to as recording medium of medium size), which is narrower than the abovementioned recording medium P1 and wider than the abovementioned recording medium P3.

2) Magnetic Flux Adjusting Member 8

As described above, the magnetic flux adjusting member 8 is a member for adjusting in size and position the area in which the magnetic flux from the coil unit 3 as the magnetic flux generating means is allowed to act on the fixation roller 1, in terms of the lengthwise direction of the fixation roller 1, that is, a member for adjusting the magnetic circuit made up of the excitation coil 6, fixation roller 1, and cores 5*a* and 5*b*, in order to adjust the temperature distribution of the fixation roller 1 in terms of the lengthwise direction thereof.

Figure 7:
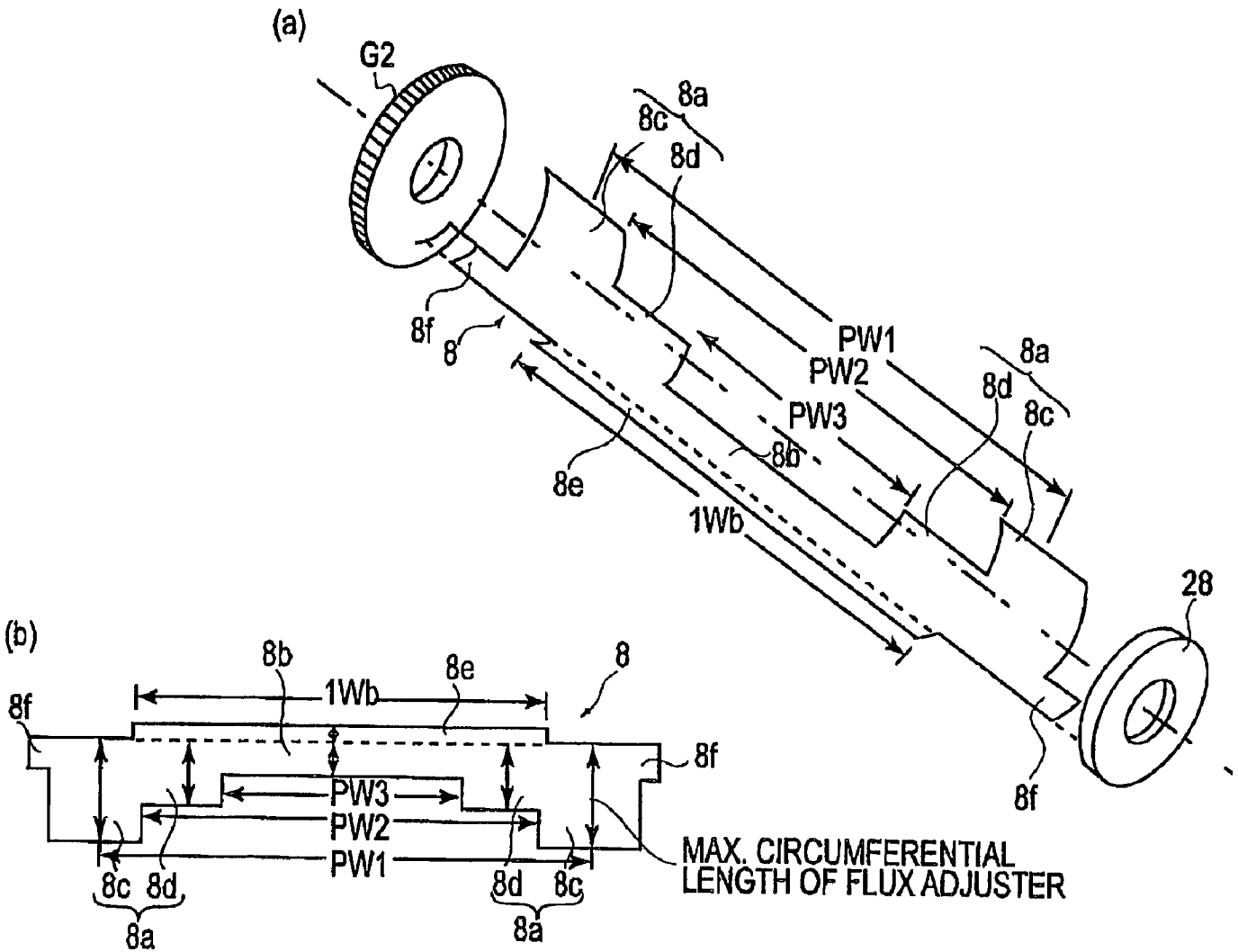
FIGS. 7(*a*) and 7(*b*) are schematic external perspective view and developmental views, respectively, of the magnetic flux adjusting member 8.
Figure 8:
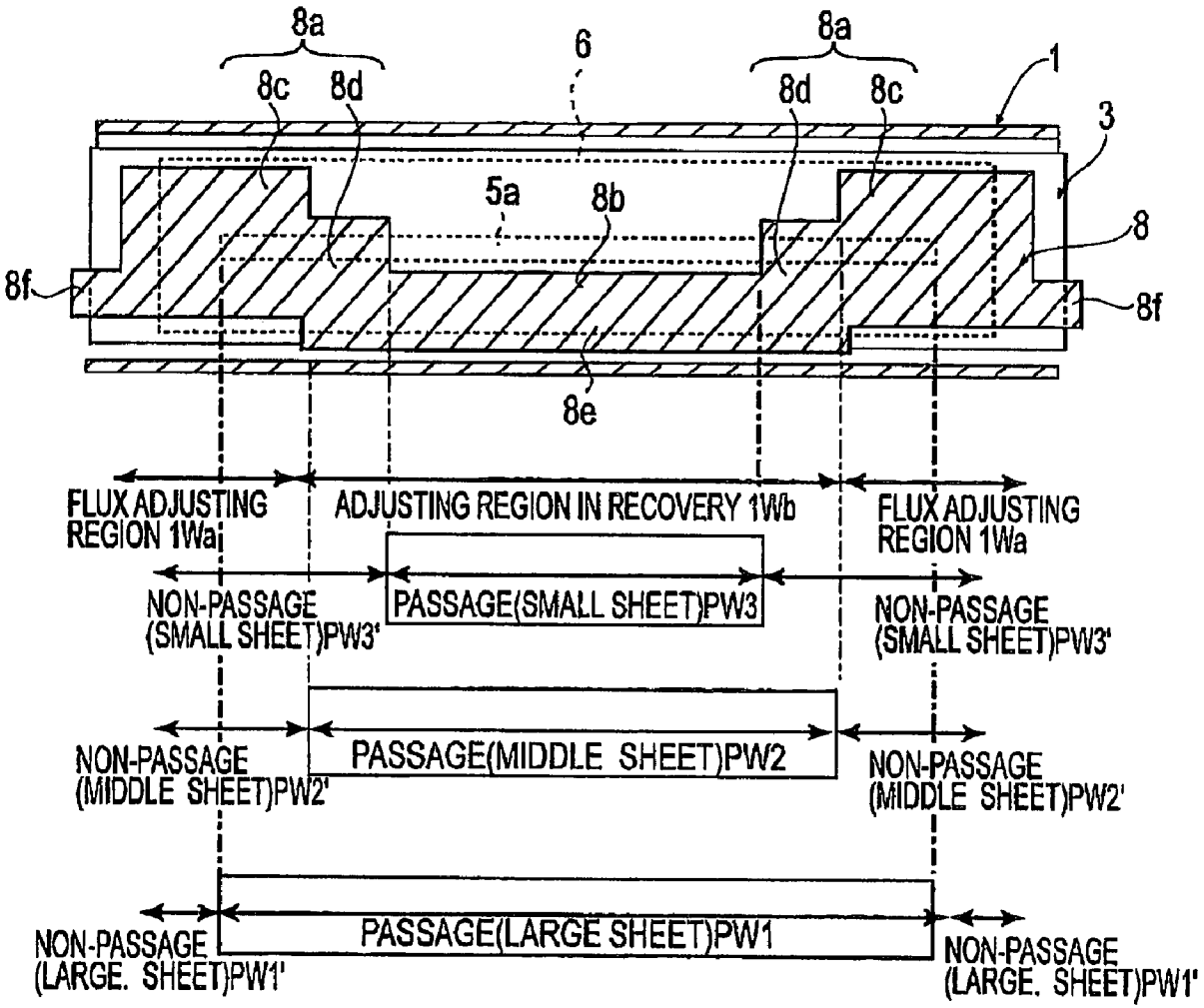
FIG. 8 is a drawing showing the relationship among the portions of the fixation roller outside or inside the recording medium path, and the path of each of the various recording mediums different in size.

FIG. 7(*a*) is a schematic external perspective view of the magnetic flux adjusting member 8, and FIG. 7(*b*) is a developmental view of the magnetic flux adjusting member 8. FIG. 8 is a drawing for describing the relationship among the portions of the fixation roller 1, which will be within, or outside, the recording medium path when various recording mediums different in size are conveyed through the fixing apparatus.

In this embodiment, the magnetic flux adjusting member 8 is disposed between the fixation roller 1 and coil unit 3 so that it is roughly coaxial with fixation roller 1. It is disposed in the hollow of the fixation roller 1 so that it can be rotationally moved in the circumferential direction of the fixation roller 1 along the internal surface of the fixation roller 1. Designated by a referential symbol G2 is a gear for driving the magnetic flux adjusting member 8. The magnetic flux member driving gear G2 is rotatably fitted around the hollow cylindrical shaft portion 4*d*, that is, the rear end portion, of the holder 4, with a bearing 27 disposed between the gear G2 and shaft portion 4*d*. Designated by a referential symbol 28 is a magnetic flux adjusting member supporting member, which is rotatably fitted around the solid cylindrical shaft portion 4*e*, that is, the front end portion, of the holder 4, with a bearing 29 disposed between the magnetic flux adjusting member supporting member and the shaft portion 4*e*. In other words, the magnetic flux adjusting member 8 is supported by its rear and front end portions 8*f* and 8*f* by being attached to the magnetic flux adjusting member driving gear G2 and magnetic flux adjusting member supporting member 28, respectively. With the employment of this structural arrangement, the magnetic flux adjusting member 8 is rendered rotatable about the axial line of the cylindrical hollow shaft portion 4*d* and axial line of the cylindrical solid shaft portion 4*e*, with the rotational axis of the magnetic flux adjusting member 8 roughly coinciding with the rotational axis of the fixation roller 1, so that the magnetic flux adjusting member 8 can be moved in the circumferential direction of the fixation roller 1, along the internal surface of the fixation roller 1, into, or out of, the areas of the gap between the fixation roller 1 and coil unit 3, which correspond in position to where the magnetic flux is allowed to act on the fixation roller 1 (magnetic flux adjusting member 8 is enabled to be moved into, or out of, position where it partially shields fixation roller from magnetic flux).

Referring to FIGS. 2 and 7(*a*), the magnetic flux adjusting member 8 in this embodiment is given an arcuate cross section, the curvature of which matches the curvature of the internal surface of the fixation roller 1 and the curvature of the excitation coil 6 on the fixation roller side. It is disposed between the internal surface of the fixation roller 1 and the coil unit 3, with the presence of preset gaps between the fixation roller 1 and magnetic flux adjusting member 8 and between the coil unit 3 and magnetic flux adjusting member 8. As the material for the magnetic flux adjusting member 8, a nonmagnetic metallic substance which is electrically conductive and small in specific resistivity is suitable; for example, copper, aluminum, silver, etc., and alloys thereof.

Referring to FIGS. 7 and 8, the magnetic flux adjusting member 8 has: a pair of magnetic flux adjusting portions 8*a* and 8*a*, which are the virtual lengthwise end portions of the magnetic flux adjusting member 8, and which are for adjusting the magnetic flux in density to prevent the fixation roller 1 from excessively rising in temperature across its lengthwise end portions; a connective portion 8*b* which connects the pair of magnetic flux adjusting portions 8*a* and 8*a*; and a magnetic flux adjusting portion 8*e* for adjusting in density the portion of the magnetic flux, which corresponds in position to the lengthwise center portion of the fixation roller 1.

The magnetic flux adjusting portions 8*a* and 8*a*, that is, the virtual lengthwise end portions, of the magnetic flux adjusting member 8 may be varied in size, in terms of the lengthwise direction of the fixation roller 1, in order to adjust in size the range, in terms of the lengthwise direction of the fixation roller 1, across which the magnetic flux is adjusted in density. Here, an example of the magnetic flux adjusting member 8, which has a pair of magnetic flux adjusting portions 8*c* and 8*c* for adjusting in density the magnetic flux when recording mediums of the medium size are used for image formation, and a pair of magnetic flux adjusting portions 8*d* and 8*d* for adjusting in density the magnetic flux when recording mediums of the small size are used for image formation, will be described.

In the case of the above described magnetic flux adjusting member 8, the magnetic flux adjusting portions 8*a* and 8*a* are the temperature reducing means for reducing the temperature of the fixation roller 1 as a heating member, across given portions in terms of the lengthwise direction thereof, and the magnetic flux adjusting portion 8*e* is the magnetic flux adjusting portion for allowing the fixation roller 1 as a heating member to recover in temperature.

In terms of the circumferential direction of the fixation roller 1, the magnetic flux adjusting portions 8*a* and 8*a*, and the magnetic flux adjusting portion 8*e*, arcuately project from the hypothetical extension of the edge of the connective portion 8*b*, extending along the internal surface of the fixation roller 1. This image forming apparatus is structured to convey recording medium in such a manner that the centerline of the recording medium, which is parallel to the recording medium conveyance direction, coincides with the lengthwise center of the fixation roller 1. Thus, the connective portion 8*b* is rendered strong enough to support the magnetic flux adjusting portions 8*a* and 8*a*, that is, the virtual lengthwise end portions, of the magnetic flux adjusting member 8, so that when a recording medium is conveyed through the fixing apparatus, the magnetic flux adjusting portions 8*a* and 8*a* remain parallel to the internal surface of the fixation roller 1. Incidentally, in the case of an image forming apparatus structured to convey recording medium in such a manner that one of the lateral edges of the recording medium is kept aligned with the positional referential marker for recording medium, or an image forming apparatus structured so that the magnetic flux adjusting member 8 does not need to be strong, the connective portion 8*b* is unnecessary. The magnetic flux adjusting member 8 is shaped so that when it is in the magnetic flux adjustment position, that is, the position in which it adjusts the magnetic flux, the magnetic flux adjusting portions 8*a* and 8*a* and 8*a* adjust the magnetic flux in density.

In the case of the structural arrangement of the fixing apparatus in this embodiment, the magnetic flux adjustment position is in the area, in terms of the circumferential direction of the fixation roller 1, in which the major portion of the magnetic flux from the coil unit 3 as a magnetic flux generating means is present. The temperature distribution of the fixation roller 1 in terms of the lengthwise direction of the fixation roller 1 is adjusted in the following manner: The magnetic flux adjusting member 8 is moved into the magnetic flux adjustment position, which is between the portion of the coil unit 3 and the portion of the fixation roller 1, which are in the abovementioned area in which the major portion of the magnetic flux is present, so that the magnetic flux from the coil unit 3 is adjusted in the range, in terms of the lengthwise direction of the fixation roller 1, in which the magnetic flux is allowed to act on the fixation roller 1.

The magnetic flux adjusting portions 8*a* and 8*a*, that is, the virtual lengthwise end portions of the magnetic flux adjusting member 8, include a pair of magnetic flux adjusting portions 8*c* and 8*c*, one for one. The distance between the inward edges of the magnetic flux adjusting portions 8*c* and 8*c* is rendered roughly the same as the width of the path PW2 of a recording medium of the medium size, so that the magnetic flux adjusting member 8 is enabled to control the temperature distribution of the fixation roller 1 when the recording medium P2, that is, a recording medium of the medium size, for example, size B4 or S4R, is used for image formation.

The distance between the inward edges of the magnetic flux adjusting portions 8*a* and 8*a* is rendered roughly the same as the width of the path PW3 of the recording medium of the small size to enable the magnetic flux adjusting member 8 to control the temperature distribution of the fixation roller 1 when the recording medium P3, that is, the recording medium of the small size, for example, B5R, is used for image formation.

The distance between the outward edges of the magnetic flux adjusting portions 8*a* and 8*a* and 8*a* is rendered roughly the same as the sum of the width of the path PW1 of the recording medium P1, that is, the width of a recording medium of the large size, for example, size A4, and twice the width of each of the areas PW1', which are outside the path PW1 of the recording medium P1 (with of PW1'+width of PW1+width of PW1').

In terms of the lengthwise direction of the magnetic flux adjusting member 8, the magnetic flux adjusting portion 8*e* of the magnetic flux adjusting member 8 in this embodiment is a part of the center portion of the magnetic flux adjusting member 8, and is rendered roughly the same in size the distance between the inward edges of the magnetic flux adjusting portion 8*c* and 8*c*, for the following reason. That is, referring to FIG. 7(*b*), the magnetic flux adjusting portion 8*c* of each of the magnetic flux adjusting portions 8*a* and 8*a*, which is the largest in the dimension in terms of the circumferential direction of the fixation roller l, is most affected by the magnetic flux, and therefore, reduces most in temperature the end portions of the fixation roller 1. Therefore, in terms of the lengthwise direction of the magnetic flux adjusting member, the magnetic flux adjusting portion 8*e* used for facilitating the recovery in temperature of the fixation roller 1 is desired to be positioned in the area outside the areas in which the magnetic flux adjusting portions 8*a* and 8*a* are positioned.

In this embodiment, the magnetic flux adjusting portion 8*e* of the magnetic flux adjusting member 8, which is used for the recovery in temperature of the fixation roller 1, is provided as the portion which corresponds in position to the center portion of the fixation roller 1. However, the magnetic flux adjusting member 8 may be provided with another magnetic flux adjusting portion (unshown) for the fixation roller temperature recovery, which is contiguous to the magnetic flux adjusting portion 8*e* in terms of the circumferential direction of the fixation roller 1, and the length of which, in terms of the lengthwise direction of the fixation roller 1, is roughly the same as the distance between the inward edges of the magnetic flux adjusting portion 8*c* and 8*c* dedicated to dealing with a recording medium of the small size, so that the temperature distribution of the fixation roller 1 can be more precisely controlled by using the two magnetic flux adjusting portions for the temperature recovery, in coordination with the usage of the magnetic flux adjusting portions 8*a* and 8*a*, or magnetic flux adjusting portions 8*c* and 8*c* which are the parts of the magnetic flux adjusting portions 8*a* and 8*a*, one for one.

Next, referring to FIG. 8, the first temperature detecting means 16*a*, which is one of the three temperature detecting means (16*a*-16*c*) with which the fixing apparatus (image forming apparatus) is provided to detect the temperature of the fixation roller 1, is disposed in, or in the adjacencies of, the path PW3, that is, the path of a recording medium of the small size, in terms of the lengthwise direction of the fixation roller 1. The second temperature detecting means 16*b* is disposed in, or in the adjacencies of, one of the ranges PW2', that is, the ranges across which the temperature of the fixation roller 1 is likely to excessively rise when recording mediums of the medium size are used for image formation. The third temperature detecting means 16*c* is disposed in, or in the adjacencies of, one of the ranges PW3', that is, the ranges across which the temperature of the fixation roller 1 is likely to excessively rise when recording mediums of the small size are used for image formation.

Referring to FIGS. 3 and 4, designated by a referential symbol 12 is a magnetic flux adjusting member driving mechanism as a magnetic flux adjusting member moving means for moving (displacing) the magnetic flux adjusting member 8 in response to the signals from the control portion 104. The magnetic flux adjusting member driving mechanism 12 is a driving system comprising a motor, etc., and rotationally drives the magnetic flux adjusting member 8 in the circumferential direction of the fixation roller 1 along the internal surface of the fixation roller 1 by rotationally driving the gear G2 attached to the lengthwise rear end of the magnetic flux adjusting member 8. As the motor for the magnetic flux adjusting member driving mechanism 12, a stepping motor, for example, is used. The movement of the magnetic flux adjusting member 8 is controlled by the control portion 104 in response to the temperature levels of the fixation roller 1 detected by the second and third temperature detecting means 16*b* and 16*c*; the control portion 104 controls the movement of the magnetic flux adjusting member 8 by controlling the magnetic flux adjusting member driving mechanism 12.

Figure 9:
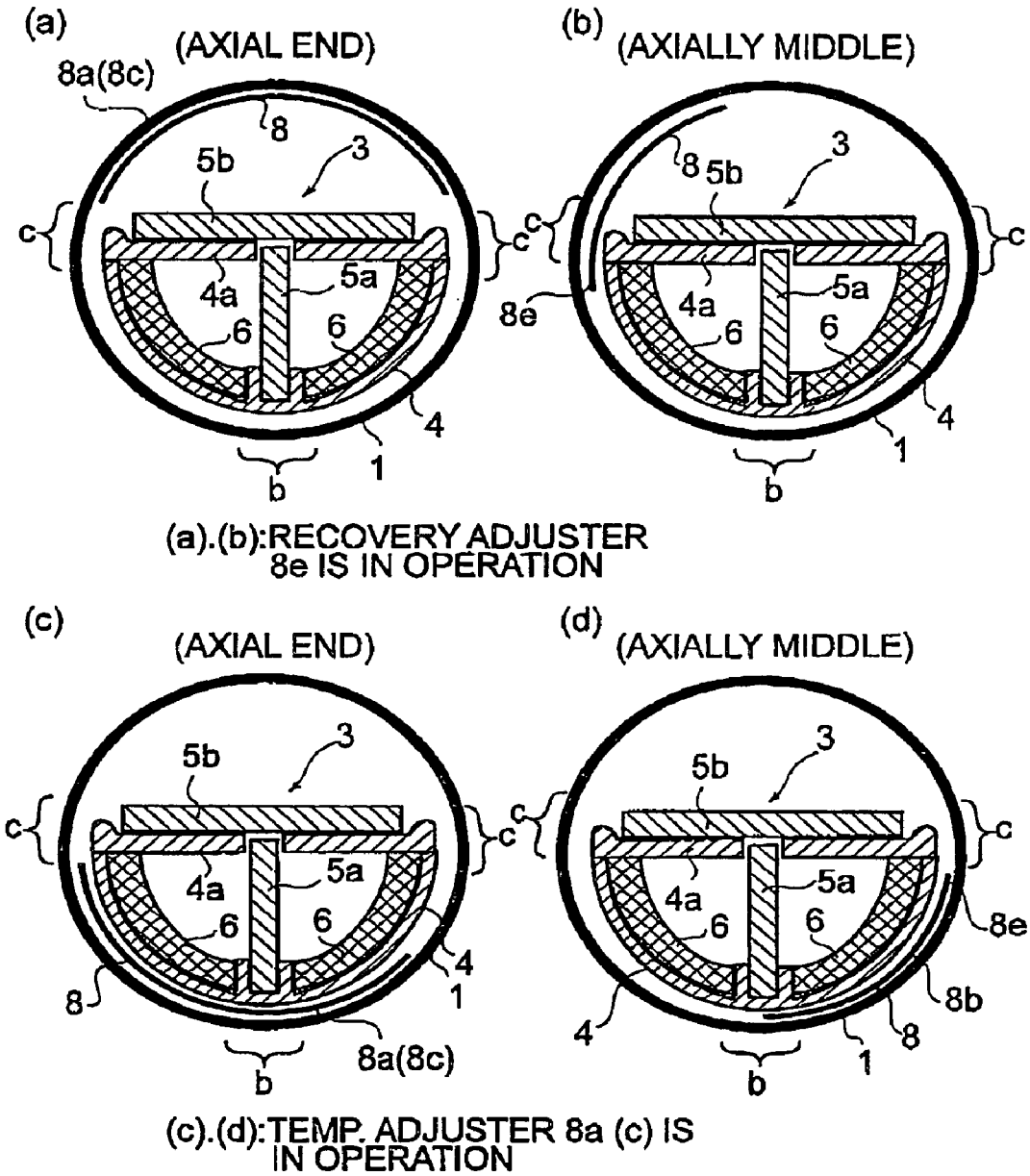
FIG. 9 is a drawing showing the movement and positioning of the magnetic flux adjusting member.

FIG. 9 shows the various positions into which the magnetic flux adjusting member 8 is moved in the hollow of the fixation roller 1. Next, referring to FIGS. 8 and 9, the positions into which the magnetic flux adjusting member 8 is movable in the hollow of the fixation roller 1 will be described In response to the temperature levels of the fixation roller 1 detected by the second and third temperature detecting means 16*b* and 16*c*, the control portion 104 controls the magnetic flux adjusting member driving mechanism 12 so that the magnetic flux adjusting member 8 is rotationally moved into the magnetic flux adjusting position, in the area, in terms of the circumferential direction of the fixation roller 1, in which the major portion of the magnetic flux from the coil unit 3 as a magnetic flux generating means is present, and in which a selected single or pair of the magnetic flux adjusting portions of the magnetic flux adjusting member 8 oppose the excitation coil 6 When the magnetic flux adjusting member 8 is in this position, the magnetic flux generated by the coil unit 3 is adjusted in density by the magnetic flux adjusting portions 8*a* and 8*a* of the magnetic flux adjusting member 8.

Referring to FIG. 8, the phenomenon that when the recording mediums of the small size are processed for fixing the images thereon, the temperature of the fixation roller 1 excessively increases across the portions in the areas PW3', that is, the areas outside the path of a recording medium of the small size, can be prevented by the magnetic flux adjusting portions 8*a* and 8*a* of the magnetic flux adjusting member 8, which correspond in position to the lengthwise end portions of the fixation roller 1. However, the magnetic flux adjusting member 8 sometimes works too effectively in its function, causing the lengthwise end portions of the fixation roller 1 to excessively fall in temperature. Once the lengthwise end portions of the fixation roller 1 excessively fall in temperature, it takes a substantial length of time for their temperature to recover to the level at which satisfactory fixation is possible. In other words, when forming an image on recording medium of a size larger than the size of the recording medium used for the immediately preceding image forming operation, an operator has to wait for a certain length of time in order to form a satisfactory image. Therefore, from the standpoint of a user, it is very important for the portions of the fixation roller 1, which have fallen in temperature, to quickly recover in temperature.

FIGS. 9(*a*) and 9(*b*) show the positioning of the magnetic flux adjusting member 8, in which the magnetic flux adjusting portion 8*e* for the fixation roller temperature recovery are the primary portion for adjusting the magnetic flux, and FIGS. 9(*c*) and 9(*d*) show the positioning of the magnetic flux adjusting member 8, in which the magnetic flux adjusting portion 8*c* and 8*c* for the prevention of the excessive temperature increase of the fixation roller 1 are primary portions for adjusting the magnetic flux. The magnetic flux adjusting portions 8*c*, 8*d*, and 8*e* are contiguous with the connective portion 8*b*. The positional relationship between primary magnetic flux adjusting portions (which in this drawing are portions 8*c* and 8*e*) is shown in the cross sectional view of the essential portions of the fixing apparatus. In the case of the example of the positional relationship between the magnetic flux adjusting portions and the excitation coil 6, which is shown here, the magnetic flux adjusting portion 8*c* and 8*c* for preventing the excessive temperature increase of the fixation roller 1 have been moved into the positions b, in which they opposes the center core 5*a*, to adjust the magnetic flux, whereas the magnetic flux adjusting portion 8*e* for the fixation temperature recovery has been moved into the position c, in which it opposes the side core 5*b*, to adjust the magnetic flux. Incidentally, the positions b into which the magnetic flux adjusting portion 8*c* and 8*c* are moved, in terms of the circumferential direction of the fixation roller 1, to control the magnetic flux, is in the adjacencies of the center core 5*a* and fixation roller 1. Similarly, the position c into which the magnetic flux adjusting portion 8*e* is moved, in terms of the circumferential direction of the fixation roller 1, to control the magnetic flux, is in the adjacencies of the side core b 5*b* and fixation roller 1. Here, in terms of the circumferential direction of the fixation roller 1, the position in which the magnetic flux adjusting member 8 is placed to control the magnetic flux is such a position that when the magnetic flux adjusting member 8 is in this position, its magnetic flux adjusting portions 8*c* or magnetic flux adjusting portion 8*e* opposes the center core 5*a* and side core 5*b*, respectively. However, the positions into which the magnetic flux adjusting portions 8*a* and 8*a*, or 8*e* are moved, in terms of the circumferential direction of the fixation roller 1, to adjust the magnetic flux, may be any position as long as the magnetic flux adjusting portions 8*a* and 8*a*, or 8*e* adjusts the magnetic flux when they are in these positions. In the case of the structural arrangement for the fixing apparatus in this embodiment, the position into which the magnetic flux adjusting member 8 is placed to adjust the magnetic flux is in the magnetic circuit made up of the excitation coil 6, fixation roller 1, and cores 5*a* and 5*b*, as described above.

FIG. 8 shows an example of the positional relationship, in terms of the lengthwise direction of the fixation roller 1, among the various components of the fixing apparatus, and the portions thereof. The recording medium paths are classified based on the size of the corresponding recording medium, more specifically, the large size (size of largest recording medium conveyable through fixing apparatus, the medium size, and the small size (size of smallest recording medium conveyable through fixing apparatus), or size of recording medium larger than recording medium of smallest size. Further, the magnetic flux adjusting member 8 is shaped so that in terms of its lengthwise direction, the distance between the front and rear magnetic flux adjusting portions 8*c* and 8*c* for dealing with a recording medium of the medium size is roughly the same as the width of the path of a recording medium of the medium size, and the distance between the front and rear magnetic flux adjusting portions 8*d* and 8*d* for dealing with a recording medium of the small size is roughly the same as the width of the path of a recording medium of the small size. In this embodiment, the sizes of the largest and smallest recording mediums conveyable through the fixing apparatus (fixing apparatus) are the sizes of the largest and smallest recording mediums usable with the image forming apparatus, which are stated in the specifications or the like of the image forming apparatus.

Figure 10:
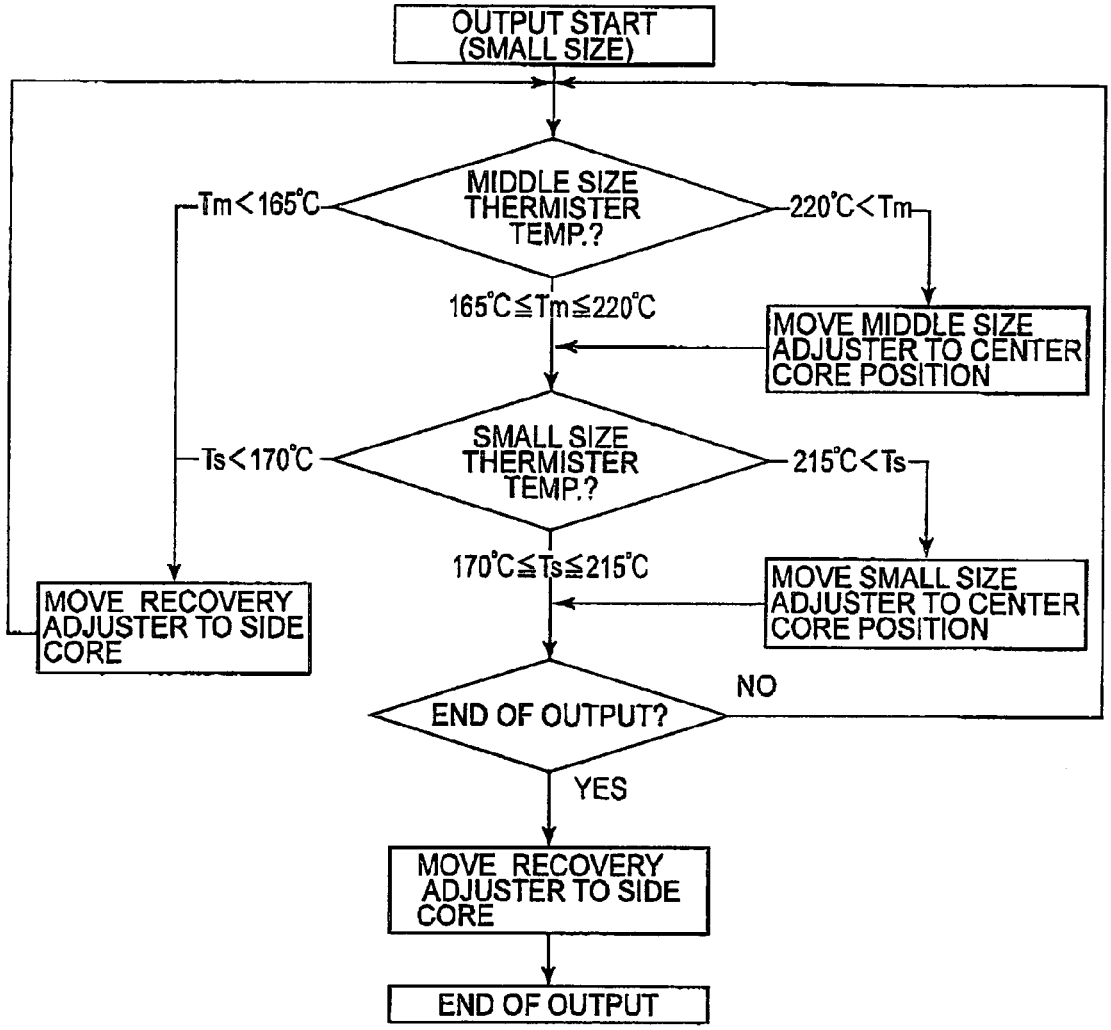
FIG. 10 is a flowchart of the operation of the fixing apparatus, regarding the movement of the magnetic flux adjusting member.

FIG. 10 is a flowchart of the operation of the magnetic flux adjusting member 8, showing from the beginning to the end of the recording medium conveyance. When recording mediums of the small or medium size are conveyed, the third temperature detecting means 16*c* (thermistor for dealing with recording medium of medium size) is used for controlling the fixation roller temperature. That is, if the temperature level of the fixation roller 1 detected by the third temperature detecting means 16*c* is excessively high, the magnetic flux adjusting portion 8*c* and 8*c* are moved into preset positions (second positions) to reduce the temperature of the fixation roller 1 across the portions corresponding to the third temperature detecting means 16*c*. On the other hand, if it is excessively low, the magnetic flux adjusting portion 8*e* for the temperature recovery is moved into a preset position (first position) to recover in temperature the portions of the fixation roller 1, which correspond in position to the third temperature detecting means 16*c*. Similarly, if the temperature level of the fixation roller 1 detected by the second temperature detecting means 16*b* (thermistor for dealing with recording medium of small size) is excessively high, the magnetic flux adjusting portions 8*d* and 8*d* are moved into preset positions. Further, a temperature recovery period is provided at the end of the recording medium conveyance. During the temperature recovery period, the magnetic flux adjusting portion 8*e* is moved into a preset position which is set by a means for setting the position(s) for the magnetic flux adjusting portion (s), to allow the temperature of the fixation roller 1 to recover.

Figure 11:
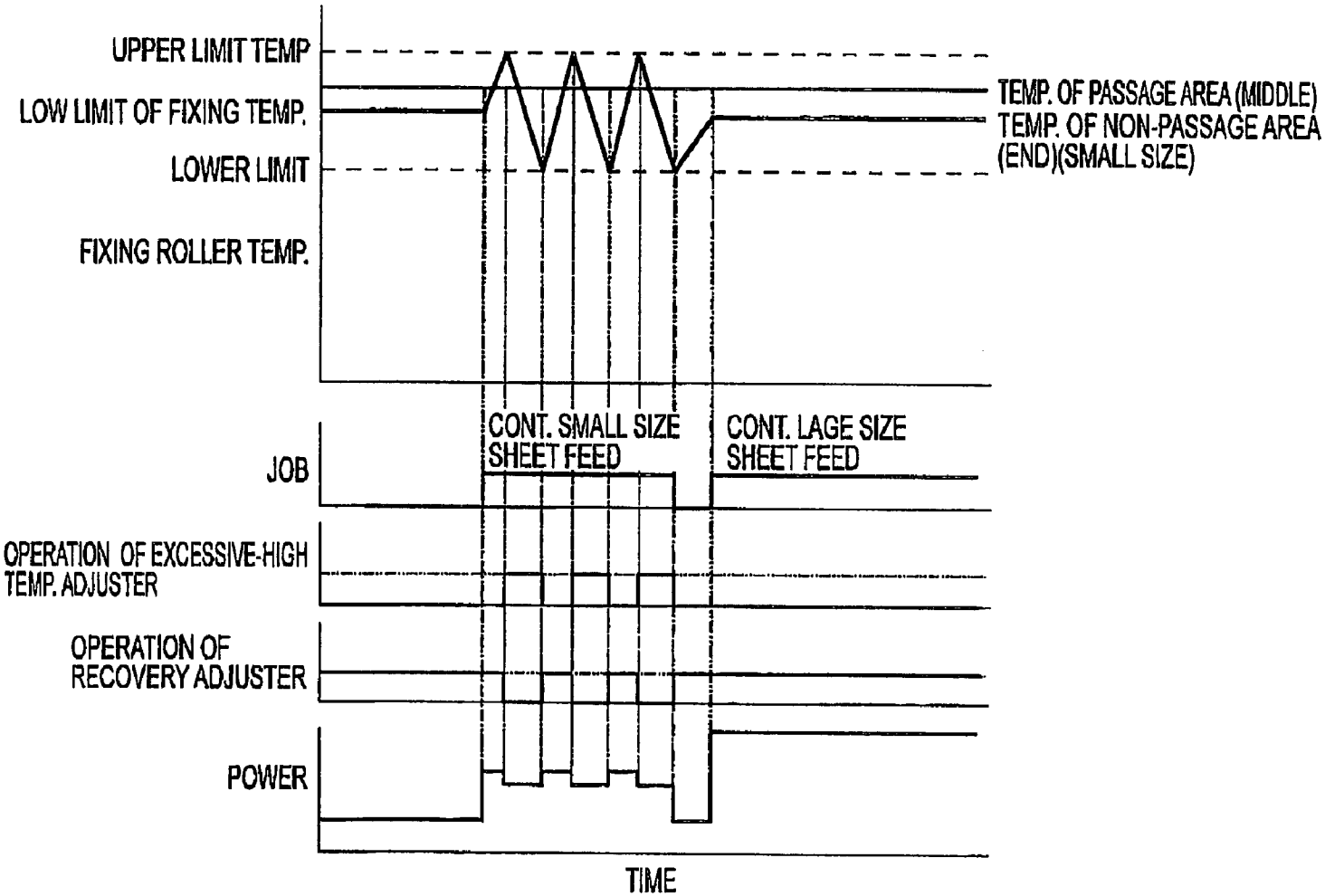
FIG. 11 is a diagram showing the chronological changes in the temperature of the various portions of the fixation roller, which occur as the magnetic flux adjusting member is moved according to the flowchart in FIG. 10.

FIG. 11 is a diagrammatic drawing showing the chronological changes in the temperature of the fixation roller 1, which occurs as recording mediums P3, that is, the recording mediums of the small size, are conveyed. As recording mediums of the small size are conveyed, the lengthwise end portions of the fixation roller 1 begins to gradually rise. Thus, as the temperature of the lengthwise end portions of the fixation roller 1 reaches the upper end of the preset temperature range for the fixation roller 1, the magnetic flux adjusting portions 8*a* and 8*a* are moved into the magnetic flux adjusting positions to reduce the temperature of the lengthwise end portions of the fixation roller 1, whereas as the temperature of the lengthwise end portions of the fixation roller 1 reaches the bottom end of the preset temperature range for the fixation roller 1, the magnetic flux adjusting portions 8*a* and 8*a* are moved into the positions in which they do not adjust the magnetic flux, to allow the temperature of the lengthwise end portions of the fixation roller 1 to rise. In other words, the recording mediums are conveyed while repeating these operational steps described above. Then, at the end of the recording medium conveyance, the magnetic flux adjusting portion 8*e* is moved into the preset position in which the magnetic flux adjusting portion 8*e* performs its function to accelerate the temperature recovery of the fixation roller 1.

The operational sequence shown in FIGS. 10 and 11 is advantageous in that the provision of the upper and bottom temperature limits for the fixation roller temperature reduces in amplitude the fluctuation in the temperature of the fixation roller 1, enabling the fixation roller 1 to quickly recover in temperature. Further, as the portions of the fixation roller 1, which correspond in position to the magnetic flux adjusting portions 8*a* and 8*a*, are excessively reduced in temperature by the function of the magnetic flux adjusting portions 8*a* and 8*a*, the magnetic flux adjusting portion 8*e* is moved into the preset position in which it performs its function, accelerating thereby the speed at which the lengthwise end portions of the fixation roller 1 recover in temperature after the completion of the conveyance of the recording mediums of the small size. In other words, the employment of the above described operational sequence makes it possible to reduce the length of time necessary for the temperature of the fixation roller 1 recover to the preset fixation level, improving thereby the image forming apparatus in usability.

Figure 12:
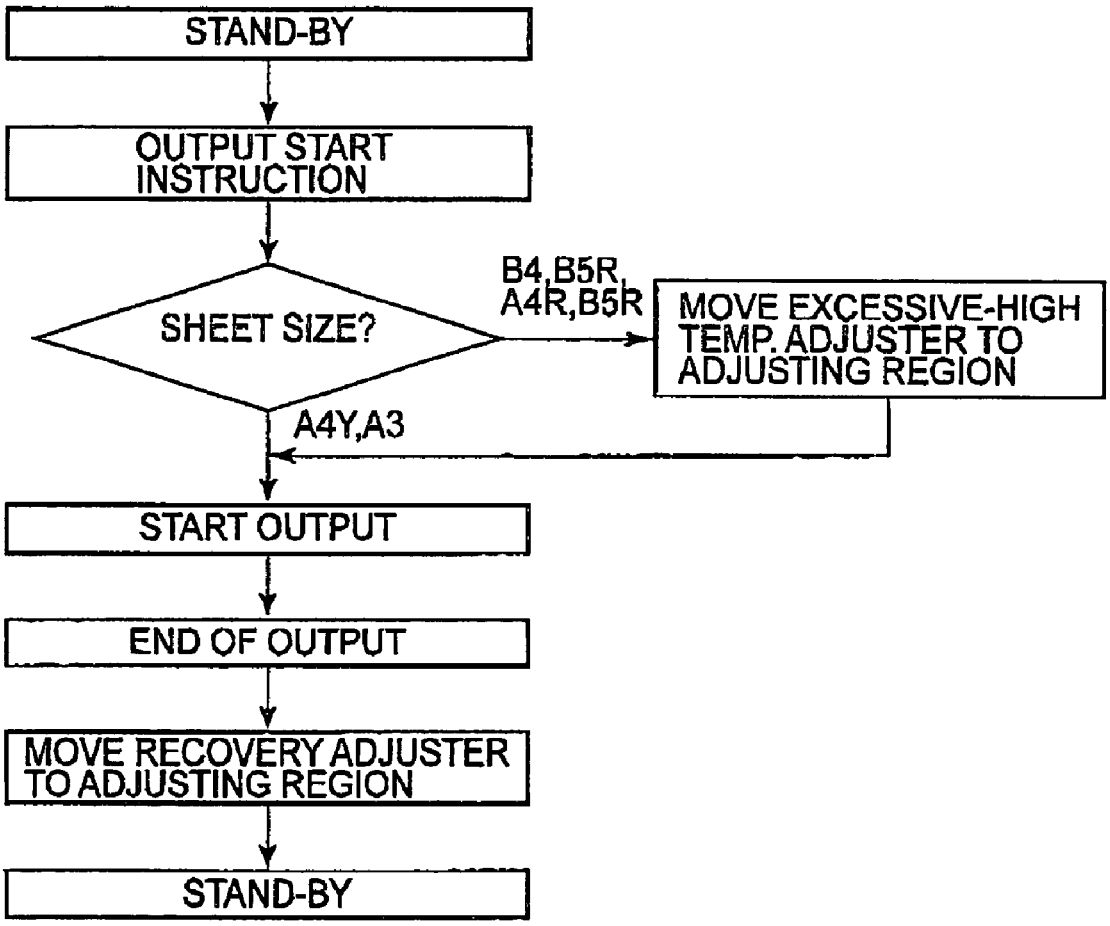
FIG. 12 is a flowchart showing the movement and positioning of the magnetic flux adjusting member, which are different from the those shown in FIG. 10.
Figure 13:
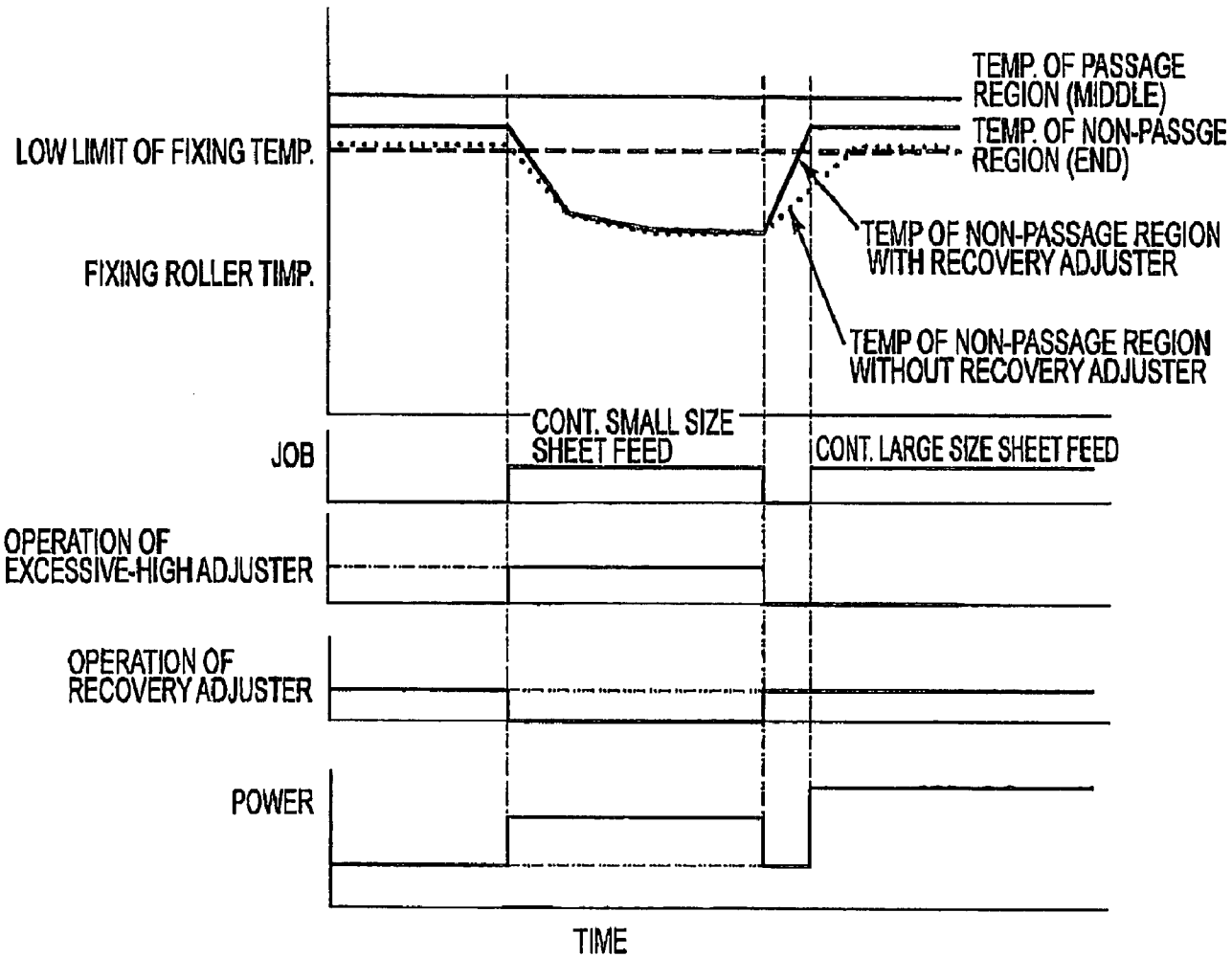
FIG. 13 is a diagram showing the chronological changes in the temperature of the various portions of the fixation roller, which occur as the magnetic flux adjusting member is moved according to the flowchart in FIG. 12.

FIGS. 12 and 13 show the flowchart of the operation of the magnetic flux adjusting member 8, which is different from the one in FIG. 11, and the chronological changes in the fixation roller temperature, which occurred as the magnetic flux adjusting member 8 was operated according to the flowchart in FIG. 12.

In the case of this example, as the fixing apparatus (image forming apparatus) which has been on standby receives an output start command, recording mediums begins to be conveyed. When the recording mediums to be conveyed is of the large size, for example, size A4Y or A3, the recording mediums are conveyed without activating the magnetic flux adjusting member 8, whereas when the size of recording mediums to be conveyed is of the small size, for example, size A4R or B5R, the recording mediums are conveyed while operating the magnetic flux adjusting member 8. After the completion of the recording medium conveyance, the temperature recovery period for allowing the lengthwise end portions of the fixation roller 1 to recover in temperature is provided. Then, the fixing apparatus is put on standby.

This operational sequence for the magnetic flux adjusting member 8 is smaller in the number of the operational steps Therefore, the employment of this operational sequence improves the fixing apparatus (image forming apparatus) in mechanical reliability. Also in the case of this example, as the portions of the fixation roller 1, which correspond in position to the magnetic flux adjusting portions 8*a* and 8*a*, are excessively reduced in temperature by the function of the magnetic flux adjusting portions 8*a* and 8*a*, the magnetic flux adjusting portion 8*e* is moved into the preset position in which it performs its function, to enable the lengthwise end portions of the fixation roller 1 to quickly recover in temperature, after the completion of the conveyance of the recording mediums of the small size. Therefore, the employment of this operational sequence also makes it possible to reduce the length of time necessary for the temperature of the fixation roller 1 to recover to the preset fixation level, improving thereby the image forming apparatus in usability.

In this embodiment, the operation of the magnetic flux adjusting member 8 is controlled in response to the temperature of the fixation roller 1 and the size of a recording medium to be (being) conveyed. However, the operation of the magnetic flux adjusting member 8 may be controlled by a timer according to a preset time table. The effects of such a control will be the same as the effects obtained by the operational sequence for the magnetic flux adjusting member 8 carried out in this embodiment. As for the selection of the temperature detecting means, an ordinary one will suffice.

Also in this embodiment, the magnetic flux adjusting member is employed as the means for reducing in temperature the lengthwise end portions of the fixation roller 1 having excessively increased in temperature. Instead, however, an ordinary method may be employed; for example, a cooling method which employs one or more fans to use air flow to cool the aforementioned overheated portions of the fixation roller 1, a cooling method which employs a pair of cooling rollers to uniformly cool the aforementioned overheated portions of the fixation roller by pressing the cooling rollers upon the abovementioned overheated portions of the fixation roller 1.

Embodiment 2

Figure 14:
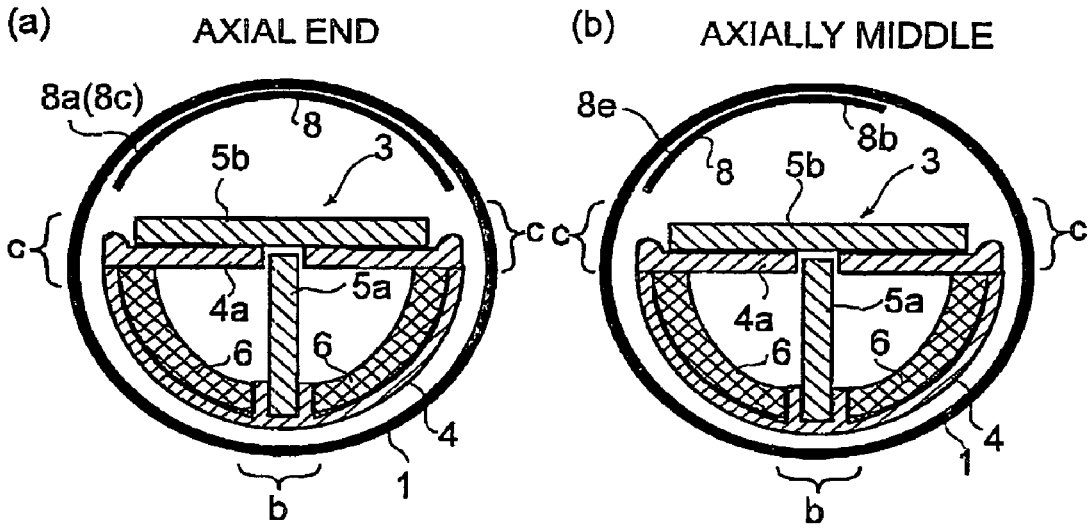
FIG. 14 is a drawing depicting the movement and positioning of the magnetic flux adjusting member in the second embodiment of the present invention.
Figure 15:
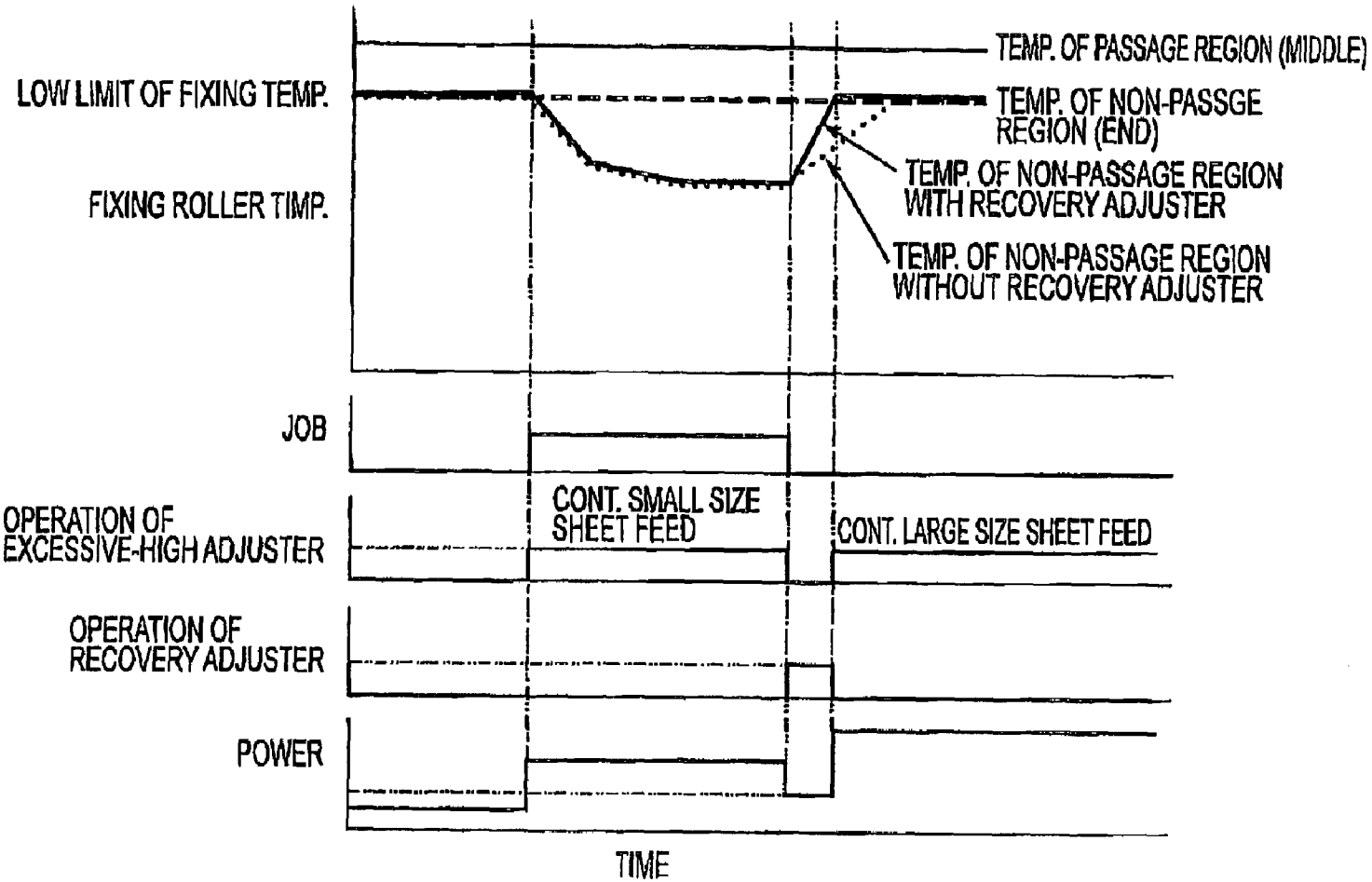
FIG. 15 is a diagram showing the chronological changes in the temperature of the various portions of the fixation roller, which occur as the magnetic flux adjusting member in the second embodiment is moved.

FIGS. 14(*a*) and 14(*b*) are cross sectional views of the essential portions of the heating assembly of the fixing apparatus in the second embodiment of the present invention, showing the positional relationship of the magnetic flux adjusting member 8 relative to the rest of the essential portions of the heating assembly. FIG. 15 is a diagrammatic drawing showing the chronological changes in the temperature of the fixation roller 1, which occurred while recording mediums of the small size were conveyed through the fixing apparatus in this embodiment.

The structures of the image forming apparatus and its fixing apparatus In this embodiment are the same as those in the first embodiment. The magnetic flux adjusting member 8 in this embodiment is different from the one in the first embodiment in that it is provided with a position (retreat) into which the magnetic flux adjusting portion 8*e* of the magnetic flux adjusting member 8, which is for the fixation roller temperature recovery, is retracted, and the operational sequence for retracting the magnetic flux adjusting portion 8*e* into the retreat.

Like the fixation roller in the above described first embodiment, while the magnetic flux adjusting portion 8*e* for the fixation roller temperature recovery is in the preset magnetic flux adjusting position, the portions of the fixation roller 1, which are outside the range of the magnetic flux adjusting portion 8*e* in terms of the lengthwise direction thereof, are greater in the amount by which heat is generated therein than the portion of the fixation roller 1 in the range of the magnetic flux adjusting portion 8*e*. Further, eddy current is induced also in the magnetic flux adjusting portion 8*e* for the fixation roller temperature recovery, by the magnetic flux. In other words, the magnetic flux is partially wasted (lost).

Thus, the fixing apparatus in this embodiment is structured so that the magnetic flux adjusting member 8 can be moved into three preset positions into which the magnetic flux adjusting member 8 is moved to adjust the magnetic flux: position in which it adjusts the magnetic flux across the portions corresponding in position to the lengthwise end portions of the fixation roller 1; position in which it adjusts the magnetic flux across the portion corresponding in position to the center portion of the fixation roller 1; and position in which it does not adjust the magnetic flux.

FIG. 14(*a*) shows an example of the positioning of the magnetic flux adjusting member 8, in which the magnetic flux adjusting portions 8*a* and 8*a* for preventing the fixation roller 1 from excessively increasing temperature across the lengthwise end potions thereof are not affected by the magnetic flux, and FIG. 14(*b*) shows an example of the positioning of the magnetic flux adjusting member 8, in which the magnetic flux adjusting portion 8*e* for the fixation roller temperature recovery is not affected by the magnetic flux. Referring to FIGS. 6 and 14, the fixing apparatus in this embodiment is structured so that the magnetic flux adjusting member 8 can be moved into three preset positions: position into which the magnetic flux adjusting member 8 can be moved to use the magnetic flux adjusting portions 8*a* and 8*a* for preventing the lengthwise portions of the fixation roller 1 from excessively increasing in temperature while recording mediums of the small size are conveyed (position for adjusting portions of magnetic flux corresponding in position to lengthwise end portions of fixation roller 1); position into which the magnetic flux adjusting member 8 can be moved to use the magnetic flux adjusting portion 8*e* for the fixation roller temperature recovery after the completion of the recording medium conveyance (position for adjusting portion of magnetic flux corresponding in position to center portion of fixation roller 1); and position (retreat) into which the magnetic flux adjusting member 8 can be moved to prevent the magnetic flux adjusting member 8 from adjusting the magnetic flux (position in which magnetic flux does not affect magnetic flux adjusting member 8).

Referring to FIG. 15, as the portions of the fixation roller 1, which are outside the recording medium path, increase in temperature while recording mediums of the small size are conveyed, the magnetic flux adjusting portions 8*a* and 8*a* for preventing the fixation roller 1 from excessively increasing temperature are used to reduce the temperature of the overheated portions of the fixation roller 1, and then, after the completion of the recording medium conveyance, the magnetic flux adjusting portion 8*e* for the fixation roller temperature recover is used to restore the fixation roller 1 in temperature. Then, after the recovery in temperature of the fixation roller 1, the magnetic flux adjusting member 8 is retracted into the position in which the magnetic flux adjusting portions 8*a* and 8*a* for the overheat prevention, and the magnetic flux adjusting portion 8*e* for the fixation roller temperature recovery, are not affected by the magnetic flux. Carrying out the above described operational sequence can reduce the amount of the loss caused by the magnetic flux adjusting member 8.

The first and second embodiments of the present invention were described with reference to the fixing apparatus through which a recording medium is conveyed so that in terms of the lengthwise direction of the fixation roller (width direction of recording medium), the centerline of the recording medium remains coinciding with the lengthwise center of the fixation roller 1. However, the present invention is also applicable, with the same effects as those obtained by the preceding embodiments, to a fixing apparatus in which a recording medium is conveyed so that in terms of the lengthwise direction of the fixation roller, one of the lateral edges of the recording medium remains aligned with the positional reference for a recording medium, with which the fixing apparatus is provided. Further, the first and second embodiments were described with reference to the fixing apparatus structured so that the coil unit 3 as the magnetic flux generating means was disposed in the hollow of the fixation roller 1 as the heating member (member in which heat is generated). However, the present invention is also applicable, with the same effects as those obtained by the preceding embodiments, to a fixing apparatus structured so that the coil unit 3 is disposed outside the fixation roller 1, as long as the fixing apparatus is structured so that the magnetic flux adjusting member 8 can be inserted between the fixation roller 1 and coil unit 3.

Further, the first and second embodiments were described with reference to the operational sequence for allowing the portions of the fixation roller 1 having excessively decreased in temperature to quickly recover in temperature. However, they are also compatible with an operation sequence for allowing the portions of the fixation roller 1 having excessively increased in temperature to quickly recover in temperature (fall in temperature to normal fixation level). In such a case, the magnetic flux adjusting member 8 is moved into the position, in which its magnetic flux adjusting portions correspond in position to the overheated portions of the fixation roller 1, to render the fixation roller 1 uniform in temperature.

The usage of the heating apparatus, in accordance with the present invention, which employs the heating method based on electromagnetic induction, is not limited to the usage as the thermal fixing apparatus in the preceding embodiments. For example, a heating apparatus in accordance with the present invention is also effective as such an image heating apparatus as a fixing apparatus for temporarily fixing an unfixed image to a sheet of recording paper, a surface property changing apparatus for reheating a sheet of recording paper bearing a fixed image to change the sheet of recording medium in surface properties, such as glossiness. Obviously, it is also effectively usable as a thermal pressing apparatus for removing wrinkles from an object to be heated, which is in the form of a sheet, a thermal laminating apparatus, a thermal drying apparatus for causing the water content in an object to be heated, such as paper or the like, to evaporate, and the like apparatuses.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 308738/2004 filed Oct. 22, 2004 which is hereby incorporated by reference.

What is claimed is:

1. A image heating apparatus comprising:

a coil for generating magnetic flux;

a rotatable heat generation member having a heat generation portion, which generates heat by magnetic flux, for heating an image on a recording material;

a temperature detecting member for detecting a temperature of said heat generation member;

an energization controller portion for controlling energization to said coil on the basis of an output of said temperature detecting member;

a first magnetic flux shielding portion for blocking, at a first magnetic flux adjustment position, the magnetic flux directed toward heat generation member from said coil toward a central portion of heat generation member, with respect to a rotational axis direction of heat generation member, while permitting the magnetic flux at an end portion, wherein the central portion includes a portion where said temperature detecting member detects the temperature of said heat generation member with respect to the rotational axis direction of said heat generation member;

a second magnetic flux shielding portion for blocking, at a second magnetic flux adjustment position, the magnetic flux which is directed toward the end portion of said heat generation member from said coil;

moving means for moving said first magnetic flux shielding portion and said second magnetic flux shielding portion; and a recovery operation controller portion for retracting said second magnetic flux shielding portion from the second magnetic flux adjustment position and moving said first magnetic flux shielding portion to the first magnetic flux adjustment position after completion of an image formation job, in which recording materials having widths as measured in a direction perpendicular to a feeding direction which are smaller than a maximum width of a recording material which can be fed are continuously fed, and executing energization control of said energization controller portion.

2. An apparatus according to claim 1, wherein during said recovery operation, said heat generation member is rotating.

3. An apparatus according to claim 1, wherein said first magnetic flux shielding portion and said second magnetic flux shielding portion are movable integrally with each other.

4. An apparatus according to claim 1, wherein during a standby period in which said apparatus waits for inputting of an image formation signal, said first magnetic flux shielding portion is in the first magnetic flux adjustment position.

5. An apparatus according to claim 1, said temperature detecting member is disposed in a range where a recording material having a minimum feedable size of said apparatus is fed.

6. An apparatus according to claim 1, further comprising a second temperature detecting member disposed in a range which is outside a range in which the recording material having a minimum feedable size of said apparatus is fed and which is within a maximum feedable range, said second temperature detecting member for detecting a temperature of said image heating member, wherein said second magnetic flux shielding portion are moved in accordance with a difference between the temperatures detected by said temperature detecting member and said second temperature detecting member.

7. An apparatus according to claim 6, further comprising rotation control means for rotating said image heating member in accordance with the difference between the temperatures detected by said temperature detecting member and said second temperature detecting member.

8. An apparatus according to claim 6, wherein when a detected temperature by said second temperature detecting member reaches a predetermined upper limit temperature during the image formation job, said second magnetic flux shielding portion placed in the second magnetic flux adjustment position is retracted from the second magnetic flux adjustment position, and when the detected temperature by said second temperature detecting member reaches a predetermined lower limit temperature, said second magnetic flux shielding portion returns to said second magnetic flux adjustment position.

9. An apparatus according to claim 1, wherein when the recording material having the maximum width is fed, said first magnetic flux shielding portion is placed in the first magnetic flux adjustment position.

10. A image heating apparatus comprising:

a coil for generating magnetic flux;

a rotatable heat generation member having a heat generation portion, which generates heat by magnetic flux, for heating a image on a recording material;

a temperature detecting member for detecting a temperature of said heat generation member;

an energization controller portion for controlling energization of said coil on the basis of an output of said temperature detecting member;

a first magnetic flux adjusting portion for adjustment, at a first magnetic flux adjustment position, such that amount of the magnetic flux directed toward heat generation member from said coil toward a central portion of said heat generation member, with respect to a rotational axis direction of heat generation member, is smaller than an amount of the magnetic flux directed toward an end portion, wherein the central portion includes a portion where said temperature detecting member detects the temperature of said heat generation member with respect to the rotational axis direction of said heat generation member;

a second magnetic flux adjusting portion for adjustment, at a second magnetic flux adjustment position, such that an amount of the magnetic flux in the central portion which is directed toward said heat generation member from said coil is smaller than an amount of the magnetic flux directed towards the end portion;

moving means for moving said first magnetic flux adjusting portion and said second magnetic flux adjusting portion; and a recovery operation controller portion for retracting said second magnetic flux adjusting portion from the second magnetic flux adjustment position and moving said first magnetic flux adjusting portion to the first magnetic flux adjustment position after completion of an image formation job in which recording materials having widths as measured in a direction perpendicular to a feeding direction thereof which smaller than a maximum width of a recording material which can be fed are continuously, and executing energization control of said energization controller portion.

11. An apparatus according to claim 10, wherein during said recovery operation, said heat generation member is rotating.

12. An apparatus according to claim 10, wherein said first magnetic flux adjusting portion and said second magnetic flux adjusting portion are movable integrally with each other.

13. An apparatus according to claim 10, wherein during a standby period in which said apparatus waits for inputting of an image formation signal, said first magnetic flux adjusting portion is in the first magnetic flux adjustment position.

14. An apparatus according to claim 10, said temperature detecting member is disposed in a range where a recording material having a minimum feedable size of said apparatus is fed.

15. An apparatus according to claim 10, further comprising a second temperature detecting member, disposed in a range which is outside a range in which the recording material having a minimum feedable size of said apparatus is fed and which is within a maximum feedable range, for detecting a temperature of said image heating member, wherein said second magnetic flux adjusting portion are moved in accordance with a difference between the temperatures detected by said temperature detecting member and said second temperature detecting member.

16. An apparatus according to claim 15, further comprising rotation control means for rotating said image heating member in accordance with the difference between the temperatures detected by said temperature detecting member and said second temperature detecting member.

17. An apparatus according to claim 15, wherein when a detected temperature by said second temperature detecting member reaches a predetermined upper limit temperature during the image formation job, said second magnetic flux adjusting portion placed in the second magnetic flux adjustment position is retracted from the second magnetic flux adjustment position, and when the detected temperature by said second temperature detecting member reaches a predetermined lower limit temperature, said second magnetic flux adjusting portion returns to said second magnetic flux adjustment position.

18. An apparatus according to claim 15, wherein when the recording material having the maximum width is fed, said first magnetic flux shielding portion is placed in the first magnetic flux adjustment position.

* * * * *